US011021847B2

(12) United States Patent
Burleson

(10) Patent No.: US 11,021,847 B2
(45) Date of Patent: Jun. 1, 2021

(54) BELL HOLE BOX

(71) Applicant: QUANTA ASSOCIATES, LP, Houston, TX (US)

(72) Inventor: Michael Todd Burleson, Del Rio, TX (US)

(73) Assignee: Quanta Associates, L.P., Houston, TX (US)

( * ) Notice: Subject to any disclaimer, the term of this patent is extended or adjusted under 35 U.S.C. 154(b) by 0 days.

(21) Appl. No.: 16/313,745

(22) PCT Filed: Jun. 30, 2017

(86) PCT No.: PCT/US2017/040439

§ 371 (c)(1),
(2) Date: Dec. 27, 2018

(87) PCT Pub. No.: WO2018/006047

PCT Pub. Date: Jan. 4, 2018

(65) Prior Publication Data

US 2019/0323195 A1 Oct. 24, 2019

Related U.S. Application Data

(60) Provisional application No. 62/356,700, filed on Jun. 30, 2016.

(51) Int. Cl.
*E02D 17/08* (2006.01)
*E04G 21/32* (2006.01)
(Continued)

(52) U.S. Cl.
CPC ..... *E02D 17/08* (2013.01); *E04G 21/32* (2013.01); *E06C 1/34* (2013.01)

(58) Field of Classification Search
CPC ..... E02D 17/02; E02D 17/04; E02D 17/06; E02D 17/08; E02D 17/083; E02D 17/086; E02D 17/10; E02D 17/12
See application file for complete search history.

(56) References Cited

U.S. PATENT DOCUMENTS 4,472,090 A * 9/1984 Krings ..... E02D 17/083 248/228.6
5,295,557 A * 3/1994 Taylor ..... E02D 29/12 182/113

(Continued)

FOREIGN PATENT DOCUMENTS

EP 0748899 A1 12/1996

OTHER PUBLICATIONS

Copenheaver, Blaine R., International Search Report for PCT/US2017/040439, dated Dec. 7, 2017, 5 pages, ISA/US, Alexandria, Virginia.

(Continued)

*Primary Examiner* — Benjamin F Fiorello
*Assistant Examiner* — Stacy N Lawson
(74) *Attorney, Agent, or Firm* — Oathout Law Firm; Mark A. Oathout

(57) ABSTRACT

A bell hole box with an open bottom for protecting construction workers from wall cave-in when working below a surface of the Earth may utilize two, opposing, generally concave walls with generally straight panels portions. The two walls may be connected using multiple spreaders that are pinned or connected to each of the two, opposing walls. Each longitudinal end of the bell hole box is open to permit passage of a pipeline through it. Numerous vertical guard posts may be connected around a top frame rail and joined together with chains. The bell hole box may be lifted in and out of a hole with mounted lifting hooks.

8 Claims, 32 Drawing Sheets

(51) Int. Cl.
*E02D 17/06* (2006.01)
*E06C 1/34* (2006.01)

(56) References Cited

U.S. PATENT DOCUMENTS

| | | | | |
|---|---|---|---|---|
| 5,306,103 | A | 4/1994 | Spencer | |
| 5,310,290 | A * | 5/1994 | Spencer | E02D 17/086 405/273 |
| 5,495,695 | A | 3/1996 | Elliott, Jr. | |
| 5,839,707 | A * | 11/1998 | Barringer | E02D 17/08 248/214 |
| 7,661,908 | B1 * | 2/2010 | Kundel, Sr. | E02D 17/08 405/272 |
| 2007/0175699 | A1 * | 8/2007 | Steblinski | E02D 17/086 182/82 |
| 2010/0034597 | A1 | 2/2010 | Kundel, Sr. | |
| 2010/0264390 | A1 | 10/2010 | Cerda | |
| 2013/0108375 | A1 * | 5/2013 | Taylor | E02D 17/04 405/282 |
| 2016/0108599 | A1 * | 4/2016 | Spry | E02D 17/08 405/282 |

OTHER PUBLICATIONS

Copenheaver, Blaine R., Written Opinion of the International Searching Authority for PCT/US2017/040439, dated Dec. 7, 2017, 7 pages, ISA/US, Alexandria, Virginia.

* cited by examiner 272
274
266
276
260
268
294
280
296
284
278
282
298
262
264

BELL HOLE BOX

STATEMENT REGARDING FEDERALLY SPONSORED RESEARCH OR DEVELOPMENT

None.

FIELD OF THE INVENTION

This invention relates to a bell hole box that may be installed at some distance below a surface of the Earth to provide a safe and comfortable space within which people may work.

BACKGROUND OF THE INVENTION

Devices known generally as trench boxes or trench shoring assemblies have been known in the field of pipeline repair and construction for years. Generally, such devices are placed into the ground to protect workers from unstable Earthen walls that may be susceptible to collapse and thus injure a human worker who may suffer an injury were it not for the vertical walls of the trench box, within which a worker is required to work. However, such devices are not without their share of limitations. Known trench boxes are generally relatively narrow and permit only certain, limited tasks to be performed within the box confines, while also limiting the number of workers who can work within the confines of the box. Furthermore, due to current designs of trench boxes, a large pipe that passes through the trench box may contact and injure workers since traditional straight walls of a trench box provide no space for a worker to reside in the event of a pipe that shifts or moves toward either wall.

What is needed then is a device and method that does not suffer from the above limitations.

BRIEF SUMMARY OF THE DISCLOSURE

In one embodiment of the present teachings, an apparatus for protecting construction workers working below a top surface of the Earth may include a first box wall, a second box wall, a first spreader positioned at 90 degrees to at least one structural side panel of first box wall and second box wall, and a second spreader positioned at 90 degrees to at least one structural side panel of first box wall and second box wall. The apparatus may further include a first spreader receiver assembly that defines a hollow cavity and is mounted to the first box wall, a second spreader receiver assembly that defines a hollow cavity and is mounted to the second box wall. At least a portion of the first spreader assembly occupies the hollow cavity of the first spreader receiver assembly and the hollow cavity of the second spreader receiver assembly. The apparatus may further include a third spreader receiver assembly that defines a hollow cavity and is mounted to the first box wall, and a fourth spreader receiver assembly that defines a hollow cavity and is mounted to the second box wall. At least a portion of the second spreader assembly may occupies the hollow cavity of the third spreader receiver assembly and the hollow cavity of the fourth spreader receiver assembly. A first spreader assembly top plate may be attached to the first spreader assembly. The first spreader assembly top plate is connected to the first box wall and the second box wall. A second spreader assembly top plate may be attached to the second spreader assembly. The second spreader assembly top plate is connected to the first box wall and the second box wall. A ladder may be attached to an interior surface of the first box wall to permit a person to easily enter and exit the apparatus.

A feature of the first embodiment may be that the first box wall has a first longitudinal end and a second longitudinal end, and the second box wall has a first longitudinal end and a second longitudinal end, such that a first distance between the first longitudinal end of the first box wall and the first longitudinal end of the second box, and a second distance between the second longitudinal end of the first box wall and the second longitudinal end of the second box wall, are both less than a midpoint distance between a midpoint of the first box wall and a midpoint of the second box wall.

In a second embodiment of the present teachings, an apparatus for protecting construction workers working below a top surface of the Earth may include a first box wall constructed generally of five straight panels, a second box wall constructed generally of five straight panels, a first spreader connected to one of the five straight panels of the first box wall and one of the five straight panels of the second box wall, a second spreader connected to one of the five straight panels of the first box wall and one of the five straight panels of the second box wall, a plurality of guard posts connected to a top frame rail of the first box wall, and a plurality of guard posts connected to a top frame rail of the second box wall. A ladder may be attached to an interior surface of the first box wall, and a top of the ladder may pivot to permit a bottom of the ladder to move away from the first box wall. An extension device may be installed on the ladder to permit the bottom of the ladder to be movable to a swung-out position away from the first box wall. A locking mechanism built into the extension device locks the bottom of the ladder in an extended position away from the first arcuate side wall. The five straight panels of the first box wall are further comprised of two coplanar panels at opposite ends of the first box wall, and the five straight panels of the second box wall are further comprised of two coplanar panels at opposite ends of the second box wall.

With respect to the second embodiment, a first spreader receiver assembly may define a hollow cavity, and a second spreader receiver assembly may define a hollow cavity, at least a portion of the first spreader occupies the hollow cavity of the first spreader receiver assembly and the hollow cavity of the second spreader receiver assembly. A third spreader receiver assembly may define a hollow cavity, and a fourth spreader receiver assembly may define a hollow cavity, and at least a portion of the second spreader occupies the hollow cavity of the third spreader receiver assembly and the hollow cavity of the fourth spreader receiver assembly.

In the second embodiment, the first spreader receiver assembly and the third spreader receiver assembly are mounted to the first box wall, and the second spreader receiver assembly and the fourth spreader receiver assembly are mounted to the second box wall. A first spreader receiver assembly pin may completely pass through the first spreader receiver assembly and the first spreader, a second spreader receiver assembly pin may completely pass through the second spreader receiver assembly and the first spreader, a third spreader receiver assembly pin may completely pass through the third spreader receiver assembly and the second spreader, and a fourth spreader receiver assembly pin may completely pass through the fourth spreader receiver assembly and the second spreader. Three of the five straight panels of the first box wall, and three of the five straight panels of the second box wall, and the first spreader, and the second spreader, form an eight-sided structure, for example in a top view.

In a third embodiment of the present teachings, an apparatus for protecting construction workers working below a top surface of the Earth may include a first arcuate side wall, a second arcuate side wall, a first spreader connected to the first arcuate side wall and the second arcuate side wall, a second spreader connected to the first arcuate side wall and the second arcuate side wall, a plurality of guard posts connected to a top frame rail of the first arcuate side wall, and a plurality of guard posts connected to a top frame rail of the second arcuate side wall. A plurality of chains may be connected to the guard posts and spanning between the guard posts. The first arcuate side wall and the second arcuate side wall may be mirror images of each other, and the first arcuate side wall and the second arcuate side wall lie partially between the first spreader and the second spreader. The apparatus may further include a first spreader receiver assembly defining a hollow cavity, and a second spreader receiver assembly defining a hollow cavity, and at least a portion of the first spreader occupies the hollow cavity of the first spreader receiver assembly and the hollow cavity of the second spreader receiver assembly. A third spreader receiver assembly may define a hollow cavity, and a fourth spreader receiver assembly may define a hollow cavity, and at least a portion of the second spreader occupies the hollow cavity of the third spreader receiver assembly and the hollow cavity of the fourth spreader receiver assembly. The first spreader receiver assembly and the third spreader receiver assembly are mounted to the first side wall, and the second spreader receiver assembly and the fourth spreader receiver assembly are mounted to the second side wall.

The third embodiment may further include a first spreader receiver assembly pin that completely passes through the first spreader receiver assembly and the first spreader, a second spreader receiver assembly pin that completely passes through the second spreader receiver assembly and the first spreader, a third spreader receiver assembly pin that completely passes through the third spreader receiver assembly and the second spreader, and a fourth spreader receiver assembly pin that completely passes through the fourth spreader receiver assembly and the second spreader. In a top view, the first spreader, the second spreader, the first arcuate side wall and the second arcuate side wall form a four-sided structure with two curved sides and two straight sides. The apparatus may further include a pointed tip along a bottom surface of the first arcuate side wall and the second arcuate side wall for engaging an Earthen surface. A ladder may be attached to an interior surface of the first arcuate side wall. The top of the ladder may pivot to permit a bottom of the ladder to move away from the first arcuate side wall, and an extension device may be connected to the ladder to permit the bottom of the ladder to be movable to a swung-out position away from the first arcuate side wall. A locking mechanism may be built into the extension device to lock the ladder in an extended position away from the first arcuate side wall.

In a fourth embodiment of an apparatus for protecting people working below a surface of the Earth may include a bottom bell hole box residing within a hole, and a top bell hole box residing on top of the bottom bell hole box. The apparatus may further include a protruding wedge portion having a slanted surface relative to a vertical surface, the protruding wedge portion protruding from a bottom surface of the top bell hole box, and a tapered surface residing around the top of the bottom bell hole box, such that the slanted surface resides against the tapered surface. The bottom bell hole box may further include a vertical side support frame, such that the protruding wedge portion of the top bell hole box resides next to the vertical side support frame. The protruding wedge portion of the top bell hole box resides against the vertical side support frame. A plurality of posts may protrude from a top of the top bell hole box, and a plurality of safety chains connected between the plurality of posts. A first ladder attached to an interior surface of the bottom bell hole box. T top of the first ladder pivots to permit a bottom of the first ladder to move away from the interior surface of the bottom bell hole box. An extension device may be mounted to the bottom of the first ladder to lock the first ladder in an extended positon away from the interior wall, yet the extension device may remain fastened to the interior wall. A second ladder may be attached to an interior surface of the top bell hole box, directly above the first ladder to facilitate climbing up or down both ladders. A plurality of guard posts may protruding from a top surface of the top bell hole box. Safety chains may be draped or connect to and between the plurality of guard posts. The walls of the bottom bell hole box and the top bell hole box may be arcuate, or the walls of the bottom bell hole box and the top bell hole box may be made of linear sections to form a working space within the bottom bell hole box and the top bell hole box.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, presented connection with FIGS. 1-38, it should be understood that the inventive features and concepts may be manifested in other arrangements and that the scope of the invention is not limited to the embodiments described or illustrated. The scope of the invention is intended only to be limited by the scope of the claims that follow.

Figure 1:
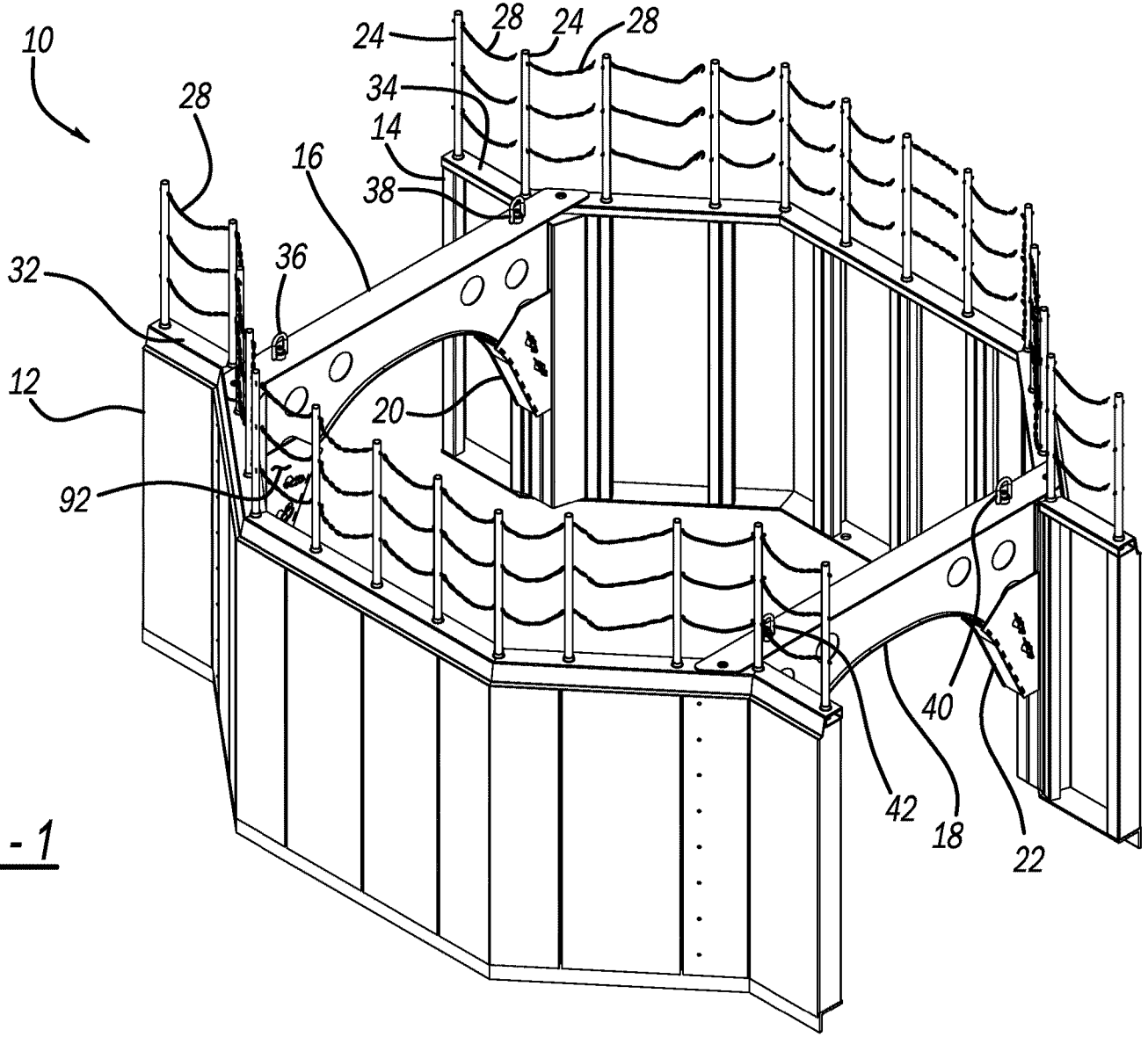
FIG. 1 is a perspective view of a bell hole box in accordance with the present teachings.

FIG. 1 depicts a bell hole box 10 permitting passage of a pipeline 11 (see FIG. 32) therethrough having major components of a first box wall 12, a second box wall 14, a first spreader 16, and a second spreader 18. The material of bell hole box 10 may be steel, aluminum, metal alloy, or suitable composite. Each box wall 12, 14 may be equipped with a spreader receiver assembly 20, 22 to receive or facilitate connection of first box wall 12 and second box wall 14 with first spreader 16. Although not depicted in FIG. 1, connection of first box wall 12 and second box wall 14 may also be facilitated using a spreader receiver assembly for each of first spreader 16 and second spreader 18 on first box wall 12, with each of first spreader 16 and second spreader 18 being received into a spreader receiver assembly on first box wall 12.

FIG. 1 also depicts numerous representative sections of a safety chain 28 that may be strung between and also connected to guard posts. As an example, one end of safety chain 28 may be connected to guard post 24 and an opposite end of safety chain 28 may be connected to guard post 24. Guard posts 28 may be inserted into holes 30 (FIG. 2) around a first box wall top surface 32 and a second box wall top surface 34. By inserting guard posts into holes 30, guard posts are held securely in place when bell hole box 10 is placed into service below a surface of Earth. For example, bell hole box 10 may be placed into the ground or Earth for use in its service position such that first box wall top surface 32 and second box wall top surface 34 are at the same level, or nearly at the same level, as a surface of Earth adjacent bell hole box 10. In such a position, people walking around a perimeter of bell hole box 10 will be protected from falling into an interior volume or space of bell hole box 10. Guard posts such as guard posts 24, 24 may be inserted along an entire top surface 32 of first box wall 12 and an entire top surface 34 of second box wall 14.

With continued reference to FIG. 1, in assembly of bell hole box 10, first spreader 16 may be lifted with hoist ring 36 and hoist ring 38 and inserted into spreader receiver assembly 20 on second box wall 14 and a corresponding spreader receiver assembly on first box wall 12. Similarly, second spreader 18 may be lifted with hoist ring 40 and hoist ring 42 and inserted into spreader receiver assembly 22 on second box wall 14 and a corresponding spreader receiver assembly on first box wall 12. Hoist rings 36, 38, 40, 42 may have threaded shafts and screw into their corresponding spreader 16, 18 as depicted in FIG. 1. It is important to note that one or more ladders 160 depicted in FIGS. 16, 19, 22, 27 and 32 may be mounted into, adapted into or otherwise installed into, in the same or similar way or position, bell hole box 10 depicted in FIG. 1, which does not specifically depict a ladder.

Figure 2:
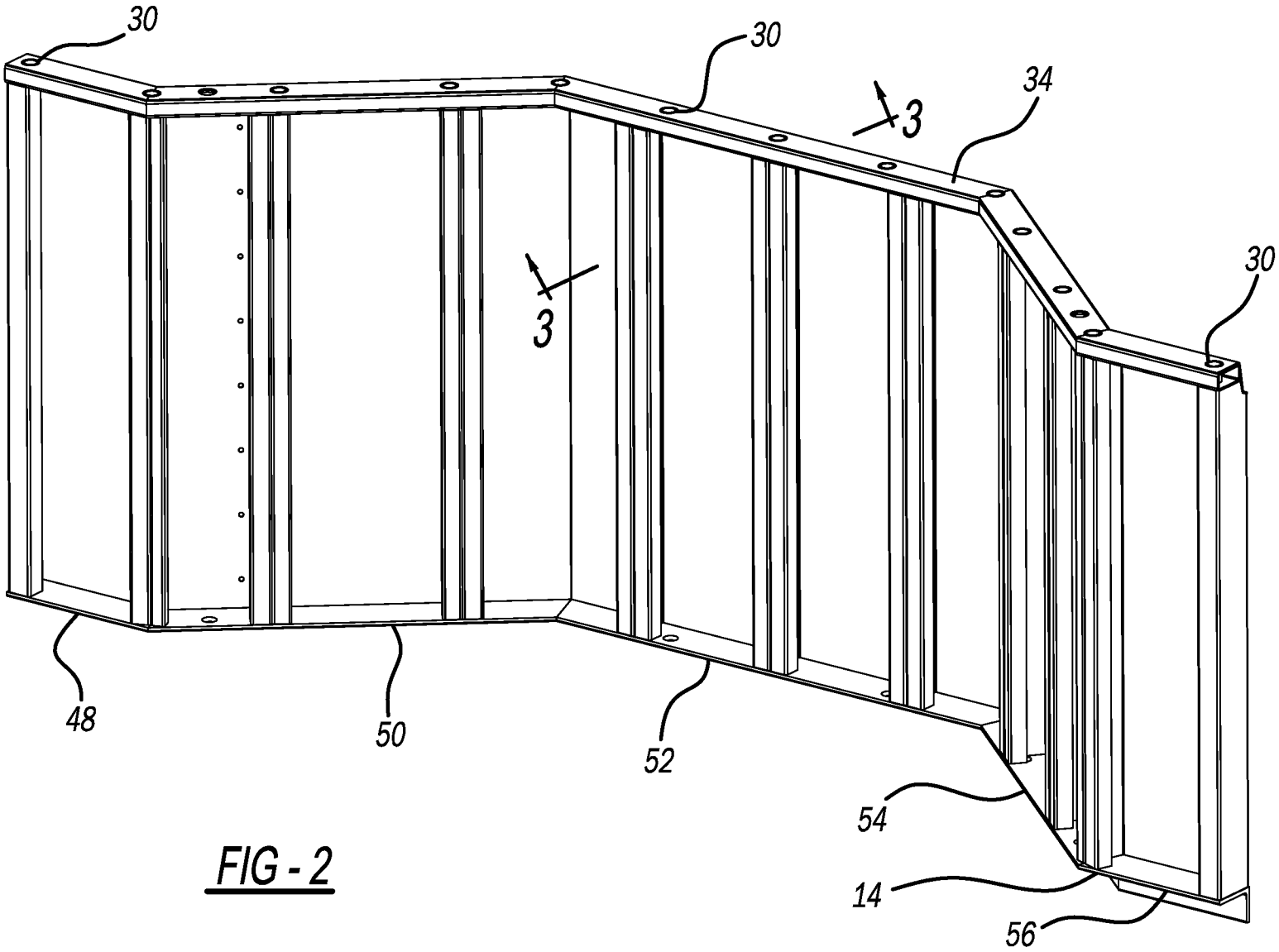
FIG. 2 is a perspective view of a wall of a bell hole box in accordance with the present teachings.
Figure 13:
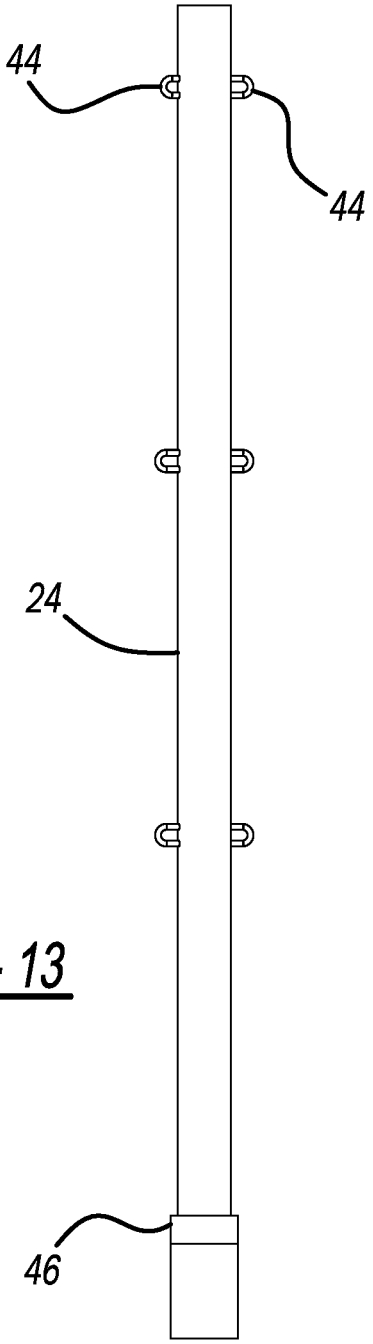
FIG. 13 is a guard post in accordance with the present teachings.

FIG. 2 depicts second box wall 14 in an upright position with numerous holes 30 located in and along second box wall top surface 34. Holes 30 are for insertion of, and for securing, guard posts 24 as depicted in a secured position in FIG. 1. FIG. 13 is an enlarged view of guard post 24 and further depicts chain connector 44, which is used to connect safety chain 28 between successive guard posts 24. Guard post 28 also has at one end a guard post stop 46, which has a diameter larger than a diameter of any hole 30, and functions to stop the guard post 24 from going too far into either first box wall top surface 32 or second box wall top surface 34. Guard posts 28 are relatively easy to insert and remove to facilitate constructing and de-constructing bell hole box 10. Continuing with FIG. 2, second box wall 14 may be a welded structure that generally has five major, separate straight portions 48, 50, 52, 54, 56, which may also be referred to as linear.

Figure 3:
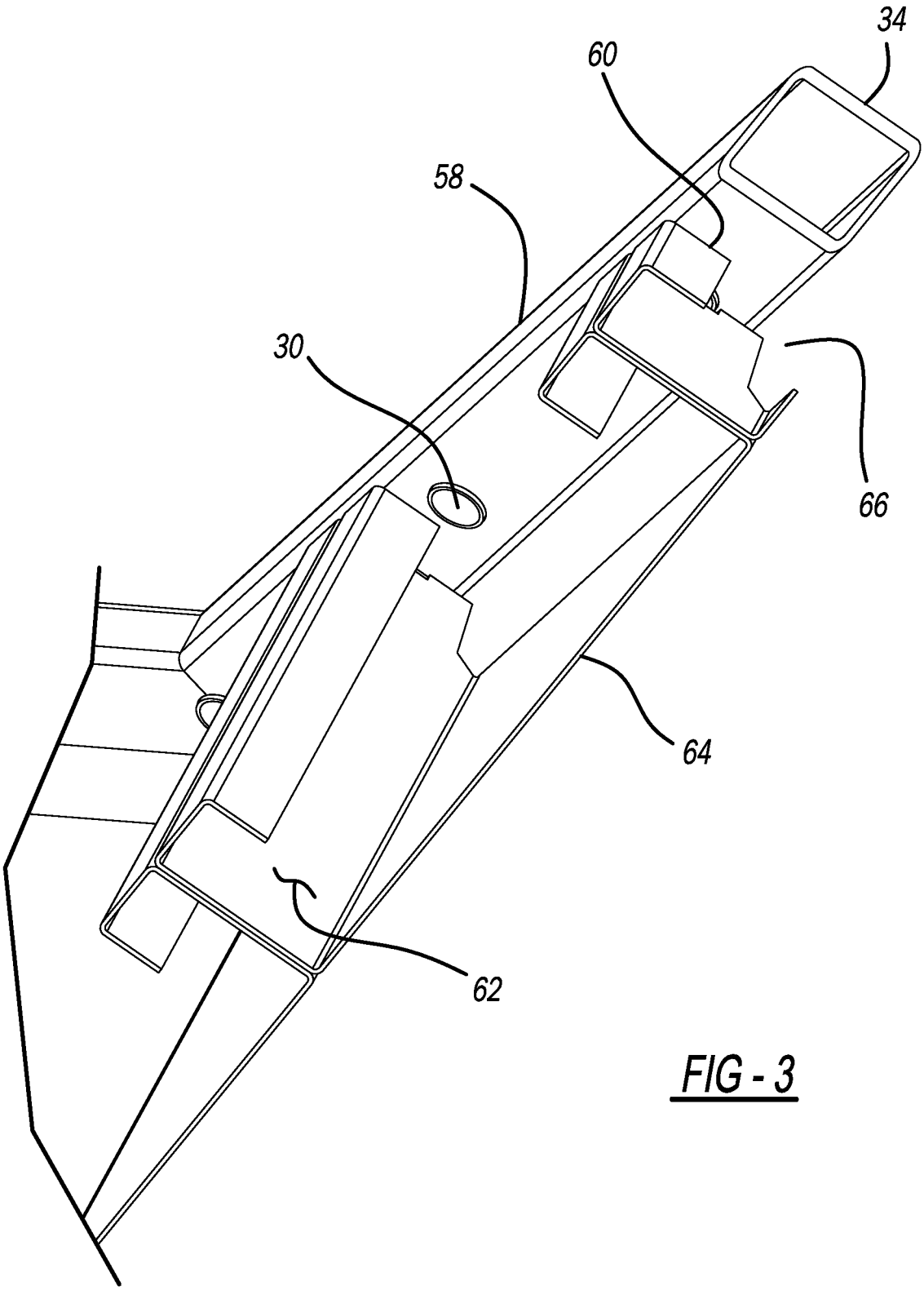
FIG. 3 is an enlarged bottom view of a portion of a top wall area of a bell hole box in accordance with the present teachings.

FIG. 3 is an enlarged view from an underside looking upward of a box rail 58. Second box wall top surface 34 is a surface of box rail 58. Box rail 58 may be attached to a skin or wall 64 by using a box rail support 60 and a box rail support 62. Welding or other fasteners could be used to attach box rail support 60 and a box rail support 62 to each of box rail and wall 64. Hole 30 is depicted in FIG. 3 as a through hole for guard post 24. FIG. 3 also depicts how a gap 66 is formed between box rail 58 and wall 64 by offsetting box rail 58 from wall 64 with box rail support 60 and box rail support 62. By offsetting box rail 58 toward an interior of bell hole box 10 relative to wall 64, as depicted in FIGS. 1-3, box rail 58, all guard posts 24, and all safety chains 28 installed around and into first box wall top surface 32 and second box wall top surface 34, will not contact the soil or Earth into which bell hole box 10 is installed or placed.

Figure 4:
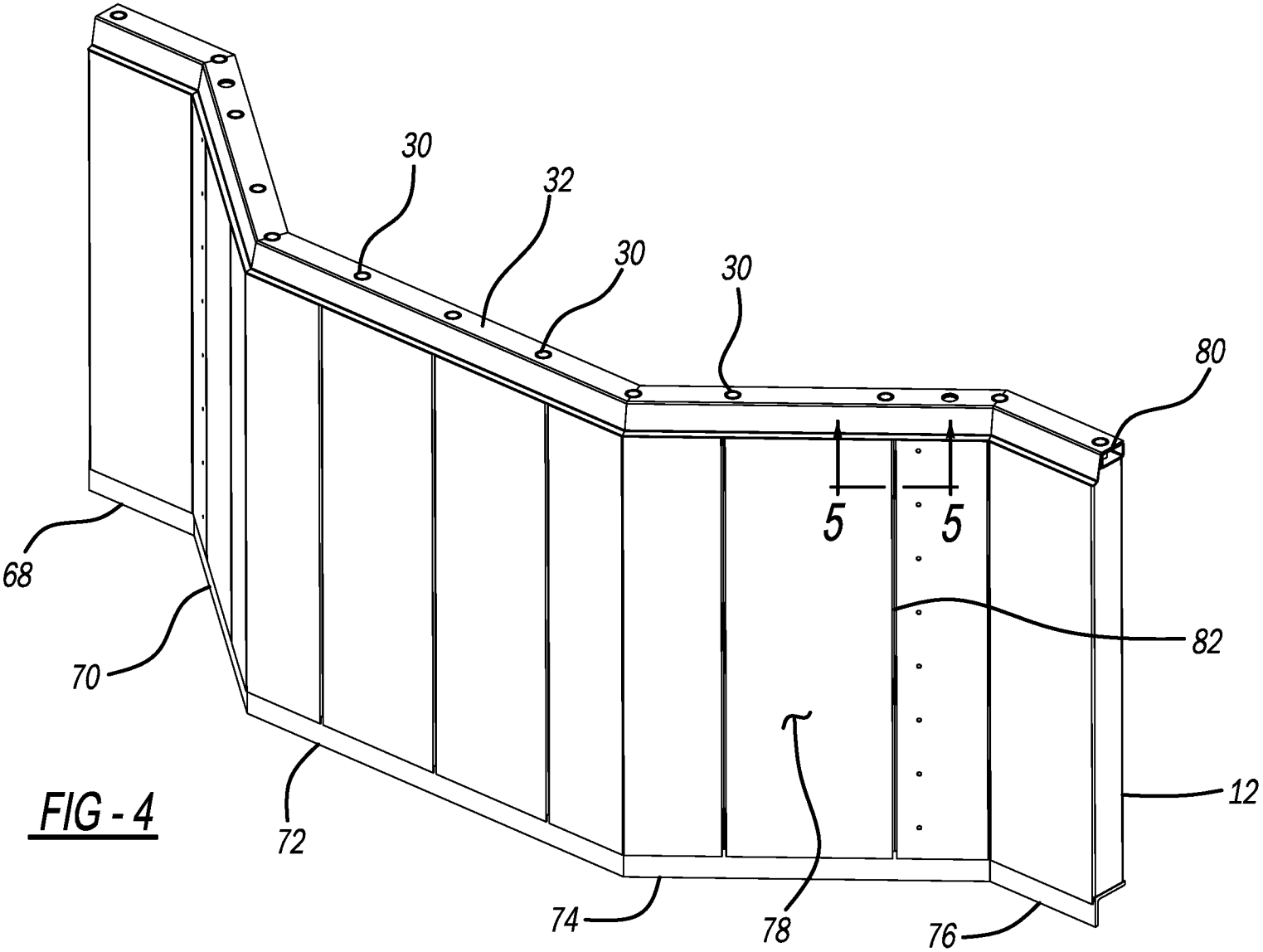
FIG. 4 is a perspective view of a wall of a bell hole box in accordance with the present teachings.
Figure 5:
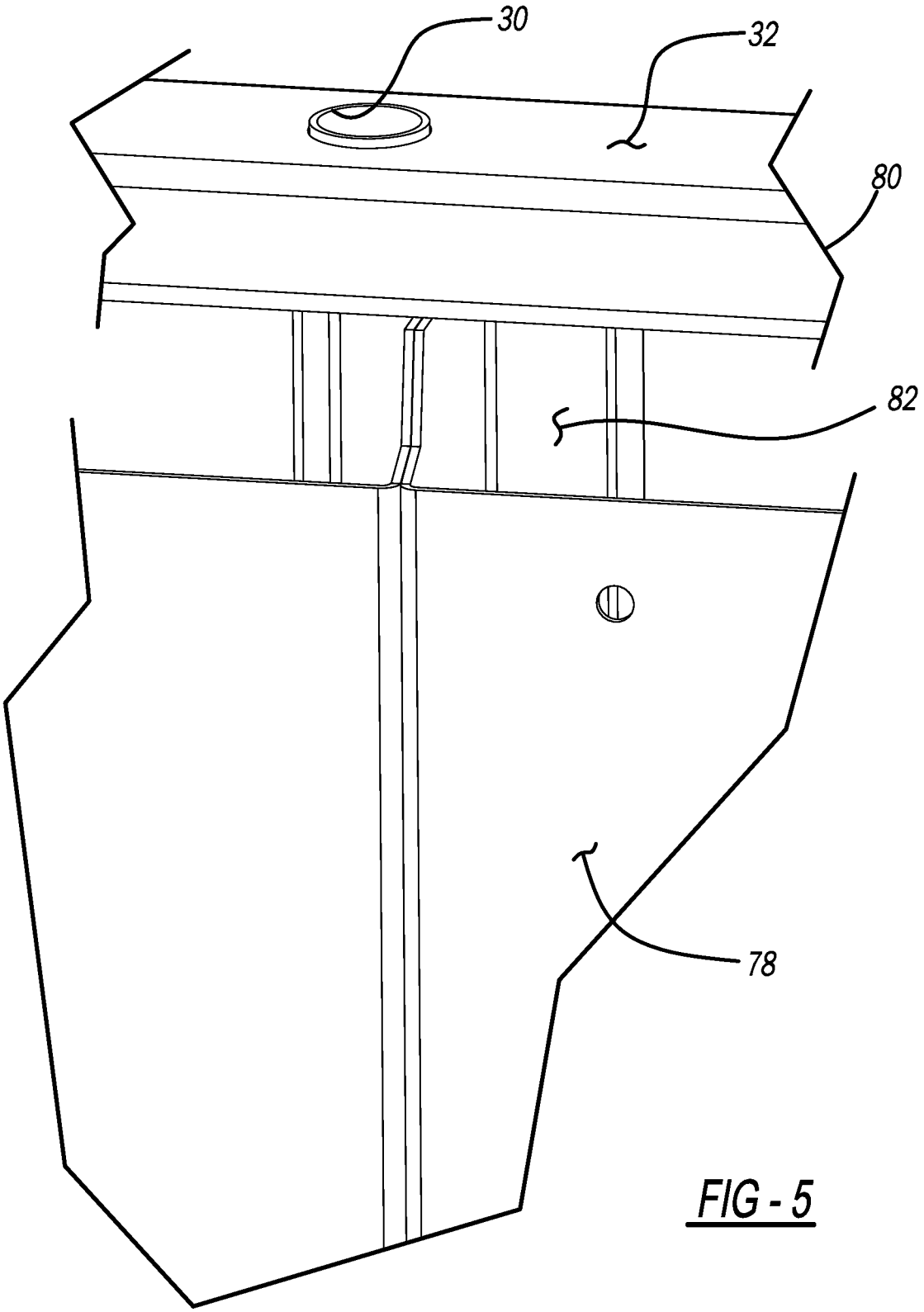
FIG. 5 is an enlarged view of a top wall area of a bell hole box in accordance with the present teachings.

FIG. 4 depicts first box wall 12 in an upright position with numerous holes 30 located in and along first box wall top surface 32. Holes 30 are for insertion of, and for securing, guard posts 24 as depicted in a secured position in FIG. 1. Second box wall 14 may be a welded structure that generally has five major, separate straight portions 68, 70, 72, 74, 76. Wall section 78 is an earth-contacting wall and is located outboard of box rail 80. Box rail 80 is in-board of an entire length of first box wall 12. Welding or another suitable fastening technique may be used to securely join wall support 82, box rail 80, and wall 78. FIG. 5 is an enlarged, underside view of box rail 80 noted in FIG. 4. Wall support 82 functions to provide connective and lateral support for wall 78 and box rail 80.

Figure 6:
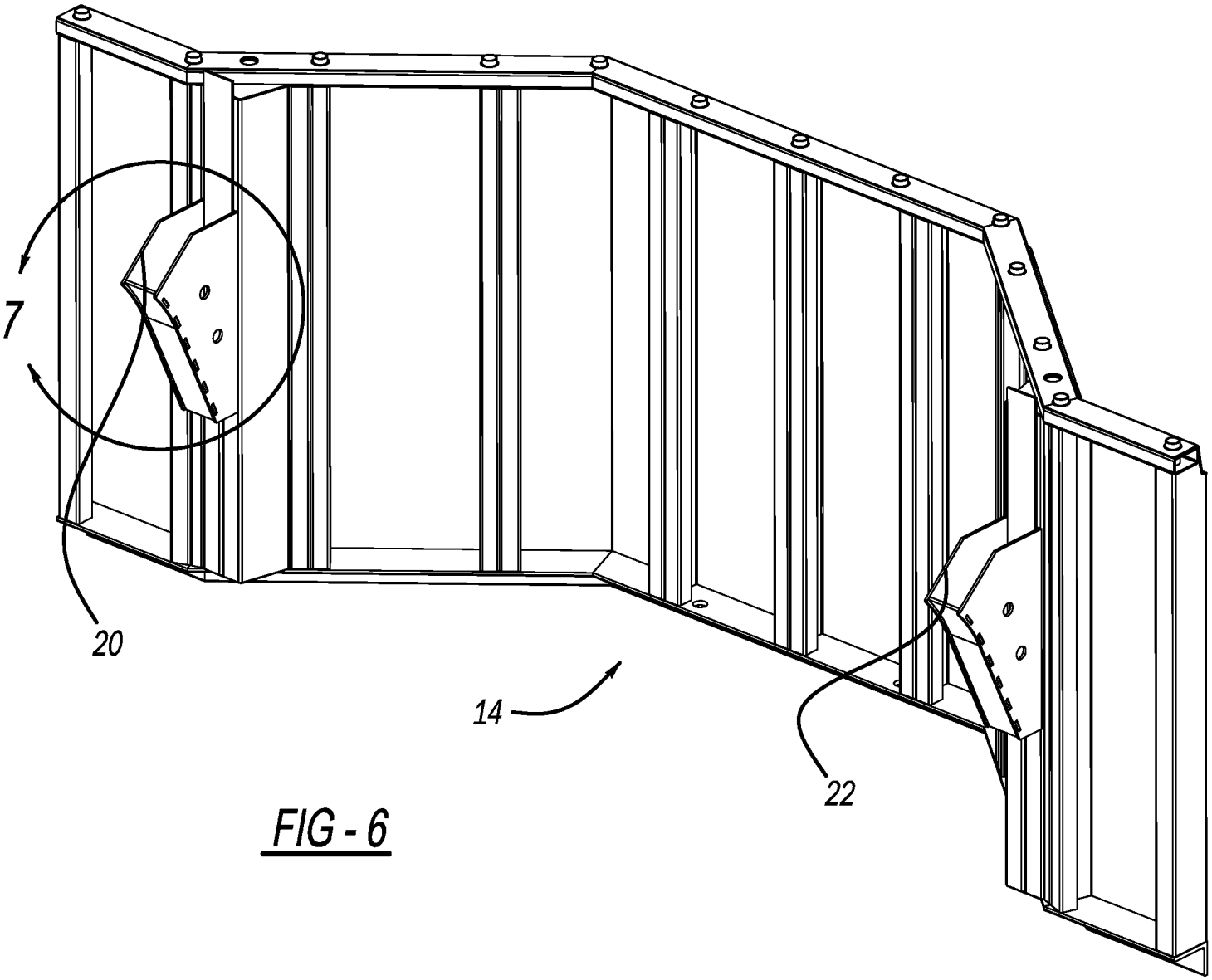
FIG. 6 is a perspective view of a wall of a bell hole box depicting a location of a connective joint receptacle with an adjacent wall in accordance with the present teachings.
Figure 7:
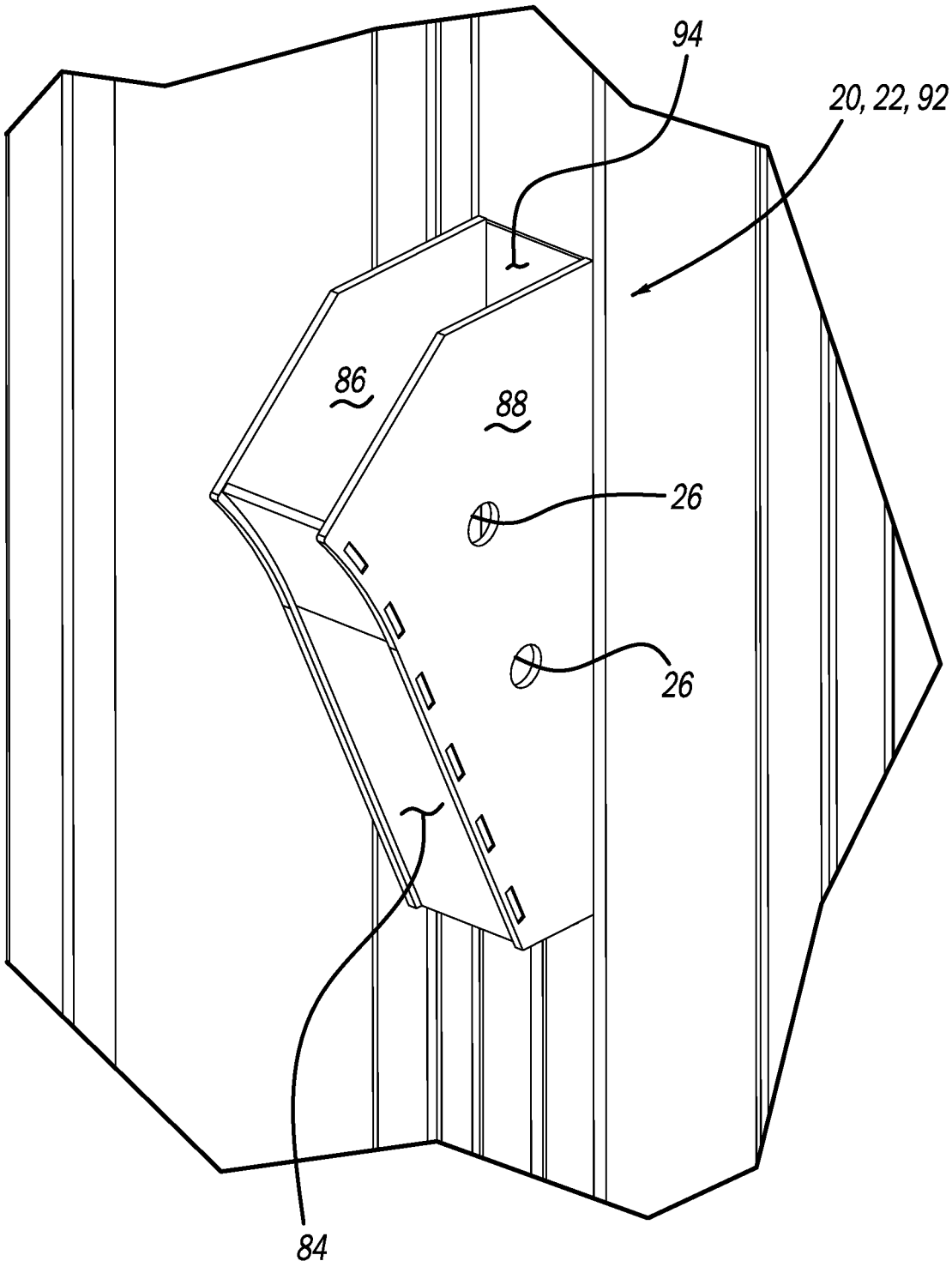
FIG. 7 is an enlarged view of a connective joint receptacle in accordance with the present teachings.

FIG. 6 depicts second box wall 14 with spreader receiver assembly 20 and spreader receiver assembly 22 connected to an interior side of second box wall 14. FIG. 7 is an enlarged view of spreader receiver assembly 20, which may be the same in construction, materials and dimensional characteristics as spreader receiver assembly 22 connected to second box wall 14, but in a different location. Spreader receiver assembly 20 may be fabricated from multiple steel parts and welded together along longitudinal edges or sides. With reference also including FIG. 14 and FIG. 15, spreader receiver assembly 20 may have an interior facing panel 84 that faces or is closest to an interior centerline of the bell hole box 10 interior, when bell hole box 10 is viewed from overhead. Interior facing panel 84 may be installed and fabricated using thru holes 90 cut into both adjacent side panels 86, 88 to which interior facing panel 84 is connected using tabs 96 cut or formed into interior facing panel 84. A rear panel 94, which may be a solid rear panel, may be used to complete a four-sided box-like structure that is spreader receiver assembly 20, 22. More specifically, interior facing panel 84 may have protruding tabs 96 that may be rectangular tabs, cut along two elongated parallel edges or sides such that when installed into each side panel 86, 88, protruding tabs 96 reside with thru holes 90, which may be rectangular through holes, of each of side panel 86, 88. Moreover, each recession 98 adjacent each protruding tab 96, 98 of interior facing plate 84 abuts against and contacts a flat surface of side panel 86, 88. With protruding tabs 96 in a rectangular shape fitted into thru holes in a rectangular shape, a relatively stronger joint is established along a length of each interior facing panel 84. Welding around or over the rectangular holes to connect interior facing panel 84 ad side panel 86, 88 may make the connection or joint even stronger.

Figure 8:
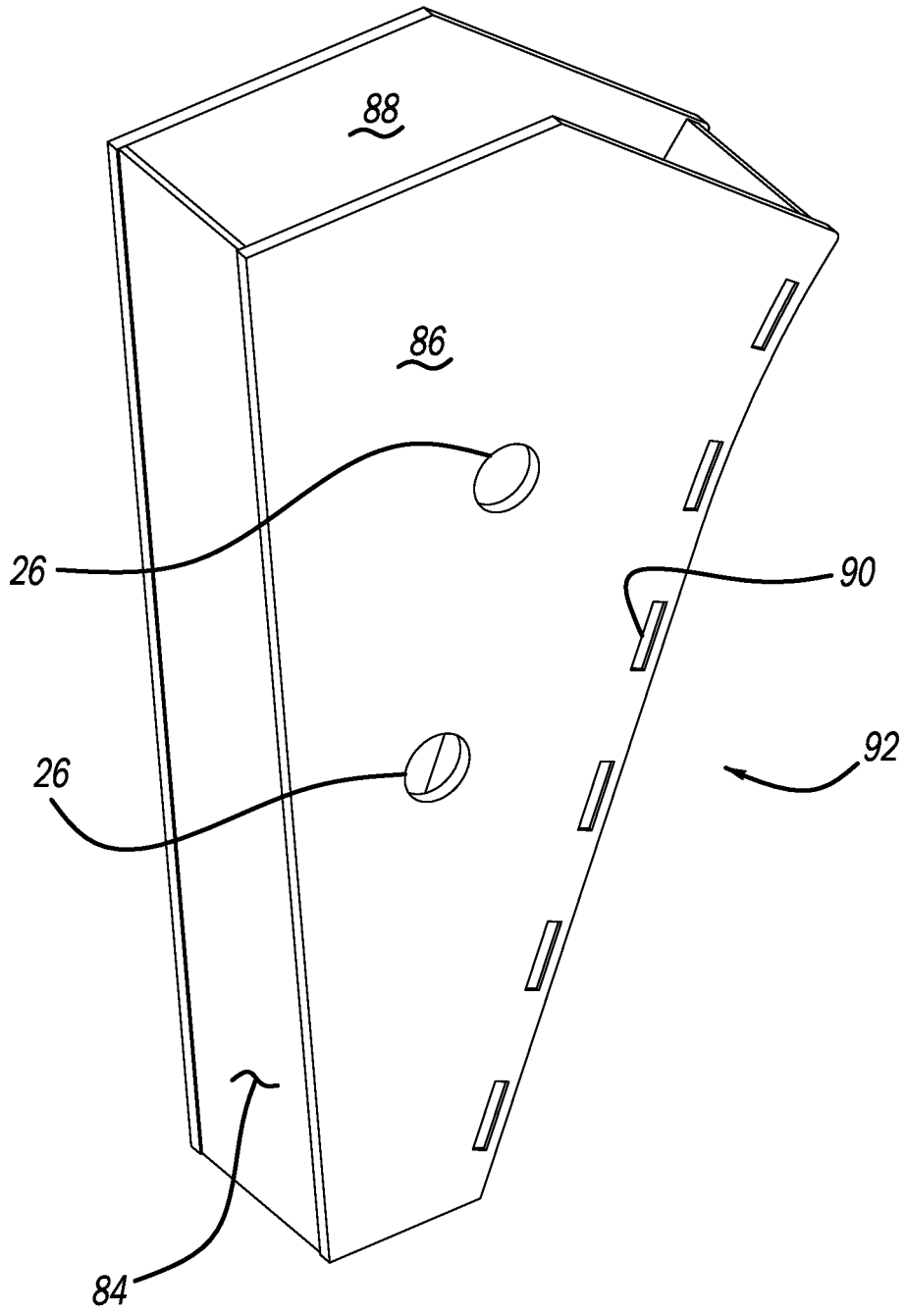
FIG. 8 is an enlarged view of a connective joint receptacle in accordance with the present teachings.

FIG. 8 depicts a spreader receiver assembly 92 typical of what may be mounted, connected or welded to an interior wall of first box wall 12 opposite spreader receiver assembly 20, 22 mounted on second box wall 14. FIG. 1 also shows spreader receiver assembly 92 in position opposite spreader receiver assembly 20 and engaging first spreader 16.

Figure 9:
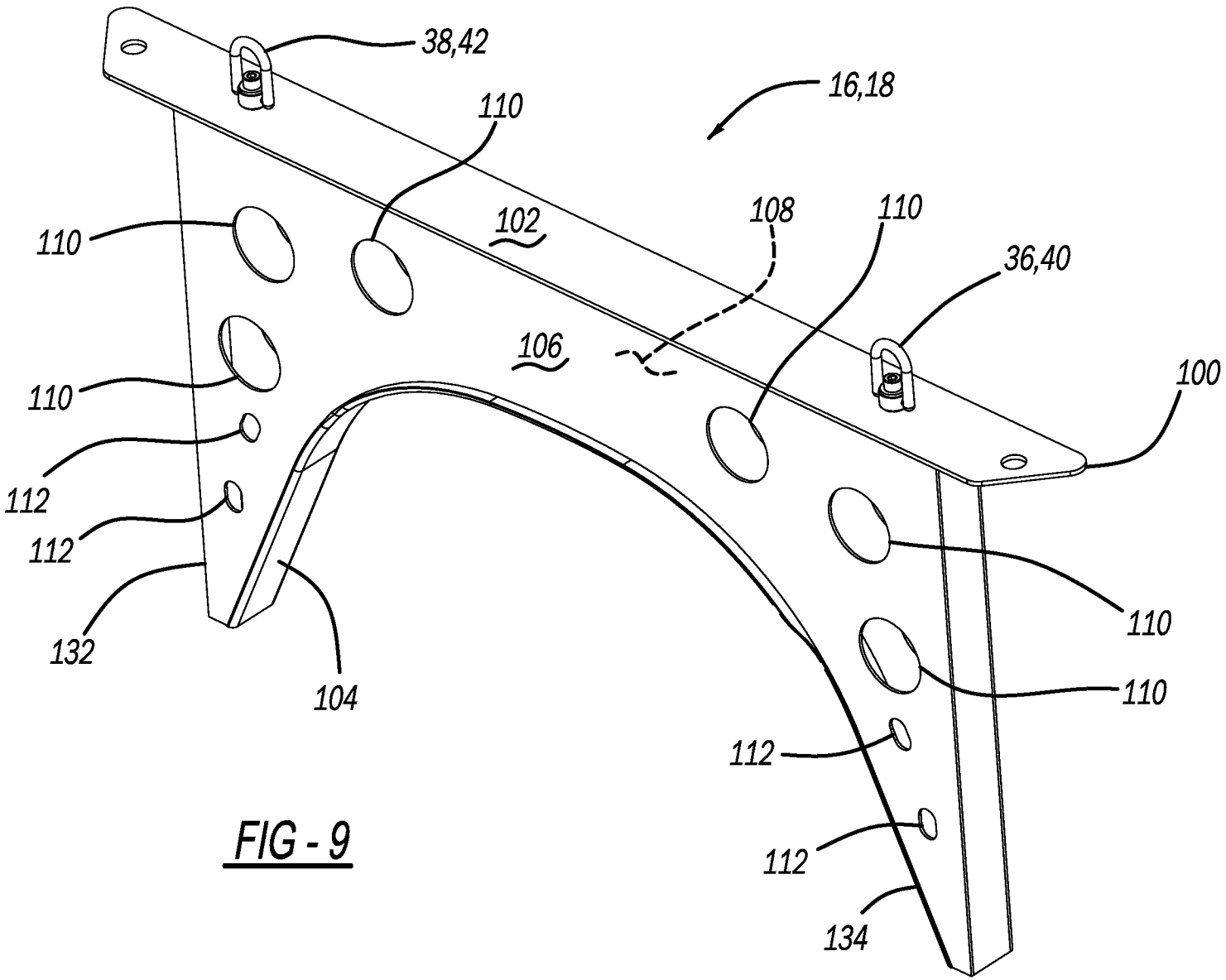
FIG. 9 is a view of a connective wall of a bell hole box in accordance with the present teachings.
Figure 10:
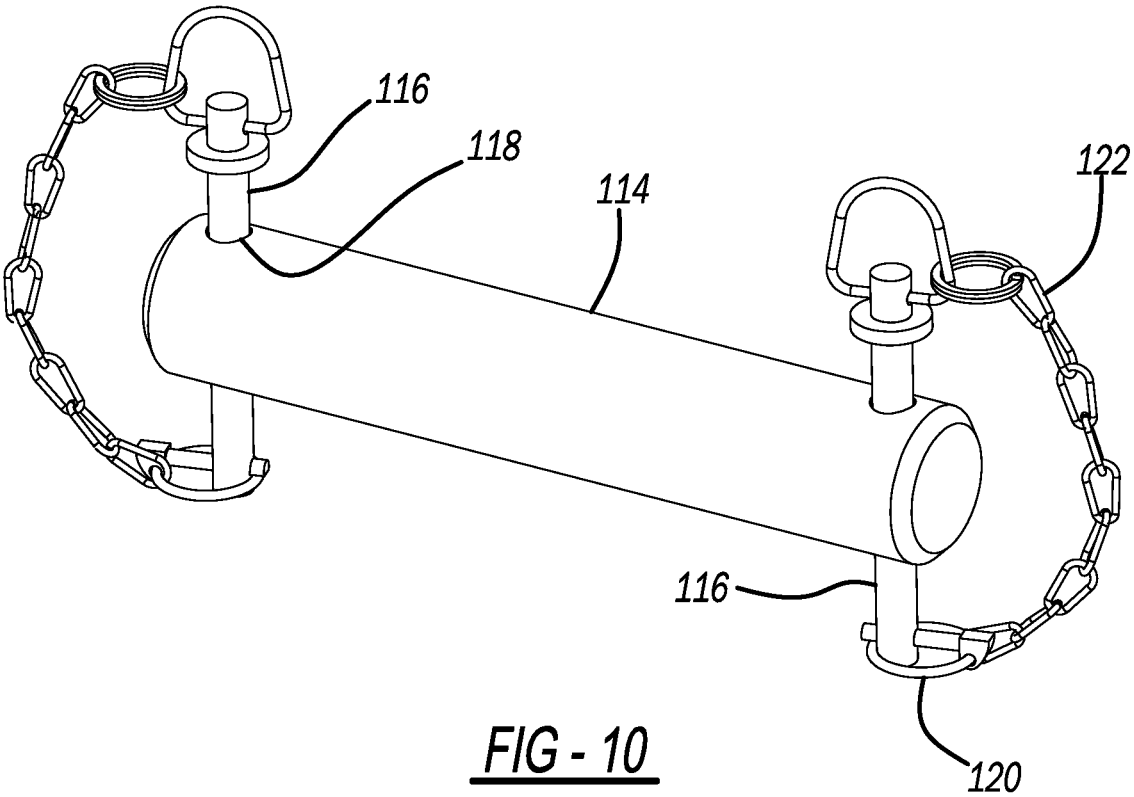
FIG. 10 is a perspective view of a receiver spreader pin in accordance with the present teachings.
Figure 11:
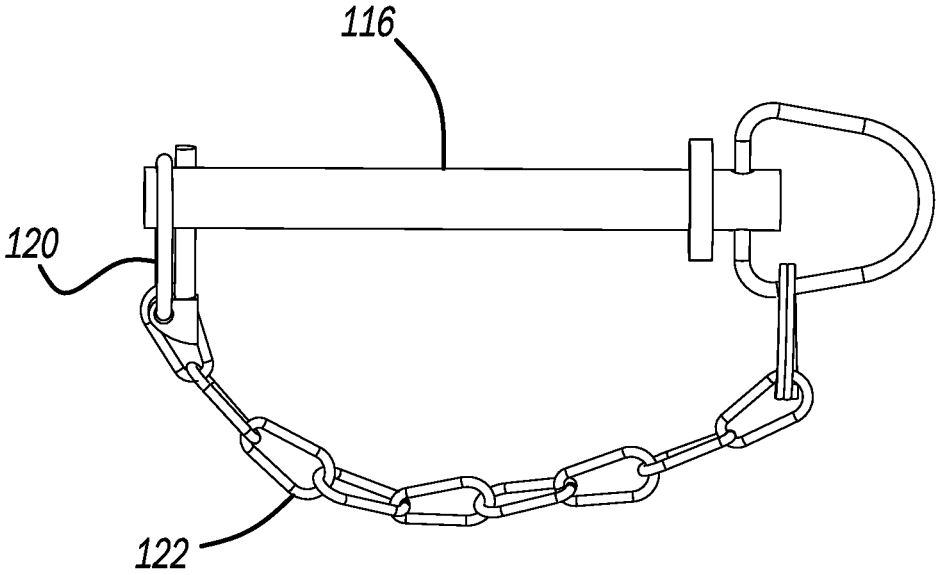
FIG. 11 is a perspective view of a hitch pin with tether and ring in accordance with the present teachings.

FIG. 9 depicts first spreader 16 and second spreader 18, also known as a connective wall, of bell hole box 10. Although two spreaders may normally be used, since their construction and function are or may be equal, discussion of only one will be made here. First spreader 16 may be entirely made of metal and may have a top plate 100 with a generally flat surface 102. Under top plate 100 may be a hollow or generally hollow cavity, with top plate 100 acting as one of the confining walls to define the hollow cavity. The other confining walls may be bottom curved plate 104 that is joined by two relatively larger side plates, first spreader side plate 106 and second spreader side plate 108, and side panel 109. As depicted in FIG. 9, through holes 110 may be cut or stamped out of each of first spreader side plate 106 and second spreader side plate 108 to create a more lightweight structure while maintaining the necessary strength requirements of first spreader 16. FIG. 9 also depicts four through holes 112, which are utilized to secure first spreader 16 and second spreader 18 to each of first box wall 12 and second box wall 14, as depicted in FIG. 1. Continuing, to secure first spreader 16 and second spreader 18 to each of first box wall 12 and second box wall 14, a clevis pin 114 (FIG. 10) may be inserted through each of through hole 112. Each clevis pin 114 may be secured or locked into position, to prevent removal of clevis pin 114 from all insertions within first spreader 16 and second spreader 18, with use of a hitch pin 116 (FIG. 11) inserted through a through hole at each end of clevis pin 114. FIG. 10 and FIG. 11 depict hitch pin 116, with FIG. 10 depicting the installation of hitch pin 116 through a through hole 118 at each end of clevis pin 114. Hitch pin 116 may utilize a hitch pin ring 120 to secure the end of hitch pin 116 that is passed through, through hole 118 of clevis pin 114. A hitch pin chain 122 may attach hitch pin ring 120 to prevent hitch pin ring 120 from becoming lost or otherwise separating from hitch pin 116.

Figure 12:
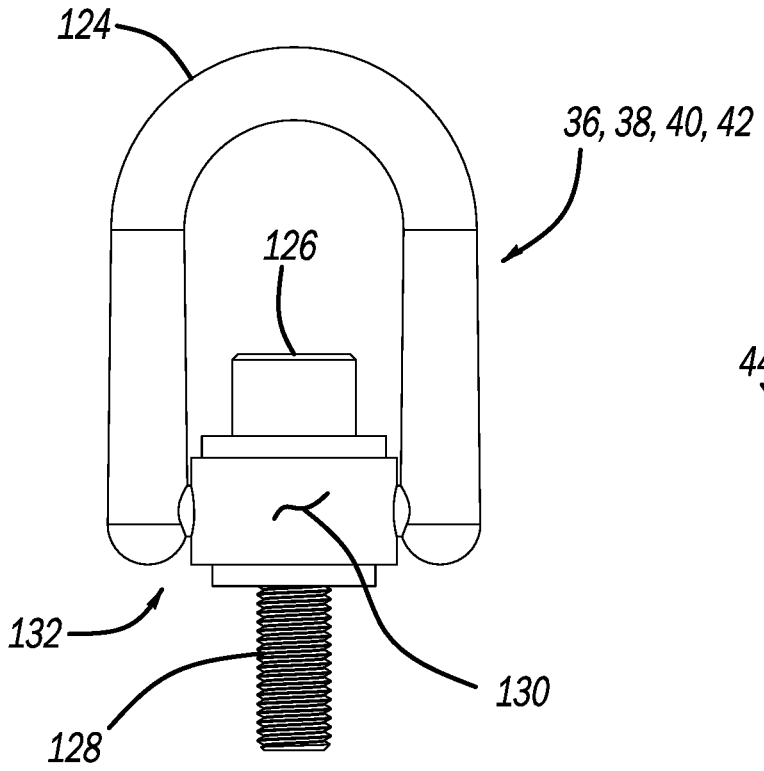
FIG. 12 is a hoist ring in accordance with the present teachings.

With reference again including FIG. 1, to assemble bell hole box 10, hoist rings 36, 38 of first spreader 16 may be lifted using a lifting strap or chain, and a suitable lifting device, such as a backhoe or similar device capable of lifting first spreader 16. FIG. 12 is an enlarged view of hoist rings 36, 38, which have component parts of a pivotable lifting loop 124, a threaded bolt 126 with threads 128, and a hub 130 through which threaded bolt 126 passes and that abuts against flat surface 102 of top plate 100. Lifting loop 124 pivots about hub 130 about pivot point 131. After first spreader 16 is lifted, and each of first box wall 12 and second box wall 14 is situated in its upright arrangement, as depicted in FIG. 1, first spreader 16 can be lowered such that first insertion leg 132 and second insertion leg 134 may be inserted into spreader receiver assembly 20 and spreader receiver assembly 92, respectively. A similar process is followed to lower second spreader 18 into its corresponding spreader receiver assemblies. Upon first spreader 16 and second spreader 18 correctly installed, two clevis pins 114 per spreader receiver assembly 20 may be installed with locking hitch pins 116. Guard posts 24 with multiple safety chains 28 installed between each guard post 24 may also be installed. As depicted in FIG. 1, the entire assembled bell hole box 10 may be lifted using hoist rings 36, 38, 40, 42 and placed into the Earth.

Figure 14:
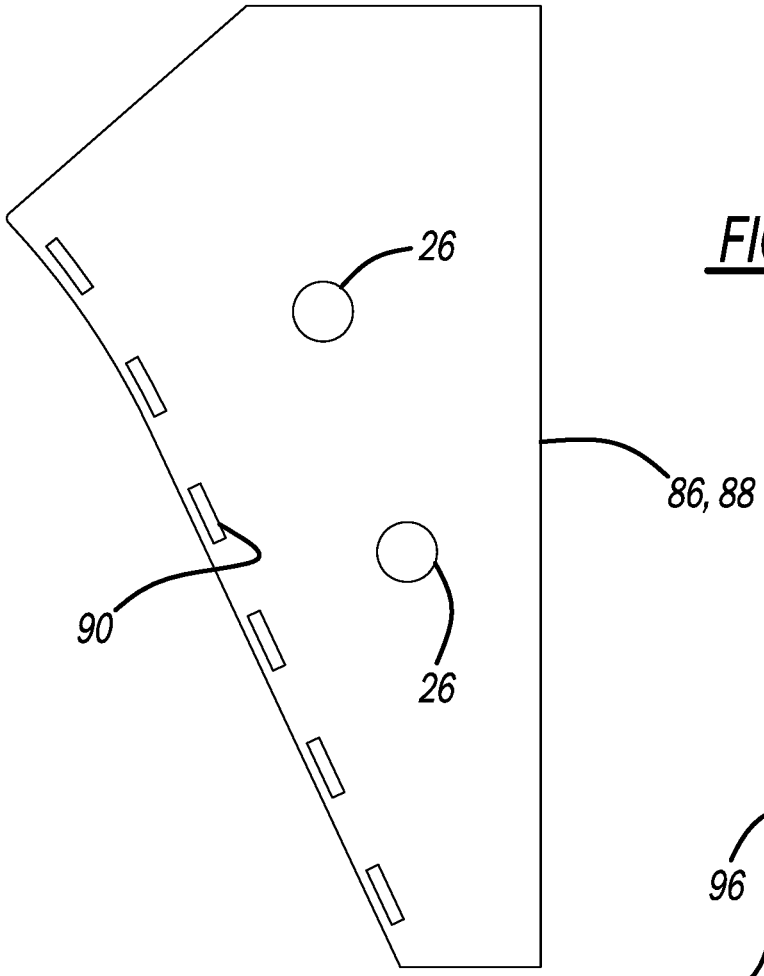
FIG. 14 is a view of side panels used to manufacture a spreader receiver assembly.
Figure 15:
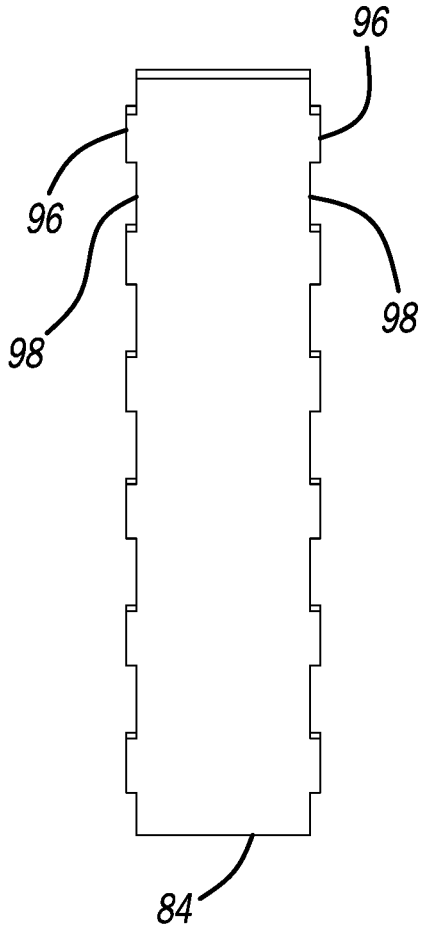
FIG. 15 is a view of a front panel used to manufacture a spreader receiver assembly.

FIG. 14 is a view of side panel 86, 88 that are used to manufacture a spreader receiver assembly 20, 22 (FIG. 7) and spreader receiver assembly 92 (FIG. 1). Side panels 86, 88 are also used to manufacture the counterpart spreader receiver assembly that cannot be seen in FIG. 1, but into which part of second spreader 18 may be inserted. FIG. 14 also depicts through holes 90 that are defined in side panel 86, 88, along a curved edge portion of side panel 86, 88 and into which tabs 96 (FIG. 15) of interior facing panel 84 may be inserted to form three sides of a spreader receiver assembly 20, 22, 92. Rear panel 94 completes the four sides of spreader receiver assembly 20, 22, 92 as depicted in FIG. 7. FIG. 7, FIG. 8, and FIG. 14 each depict through holes 26 in side panels 86, 88.

Figure 16:
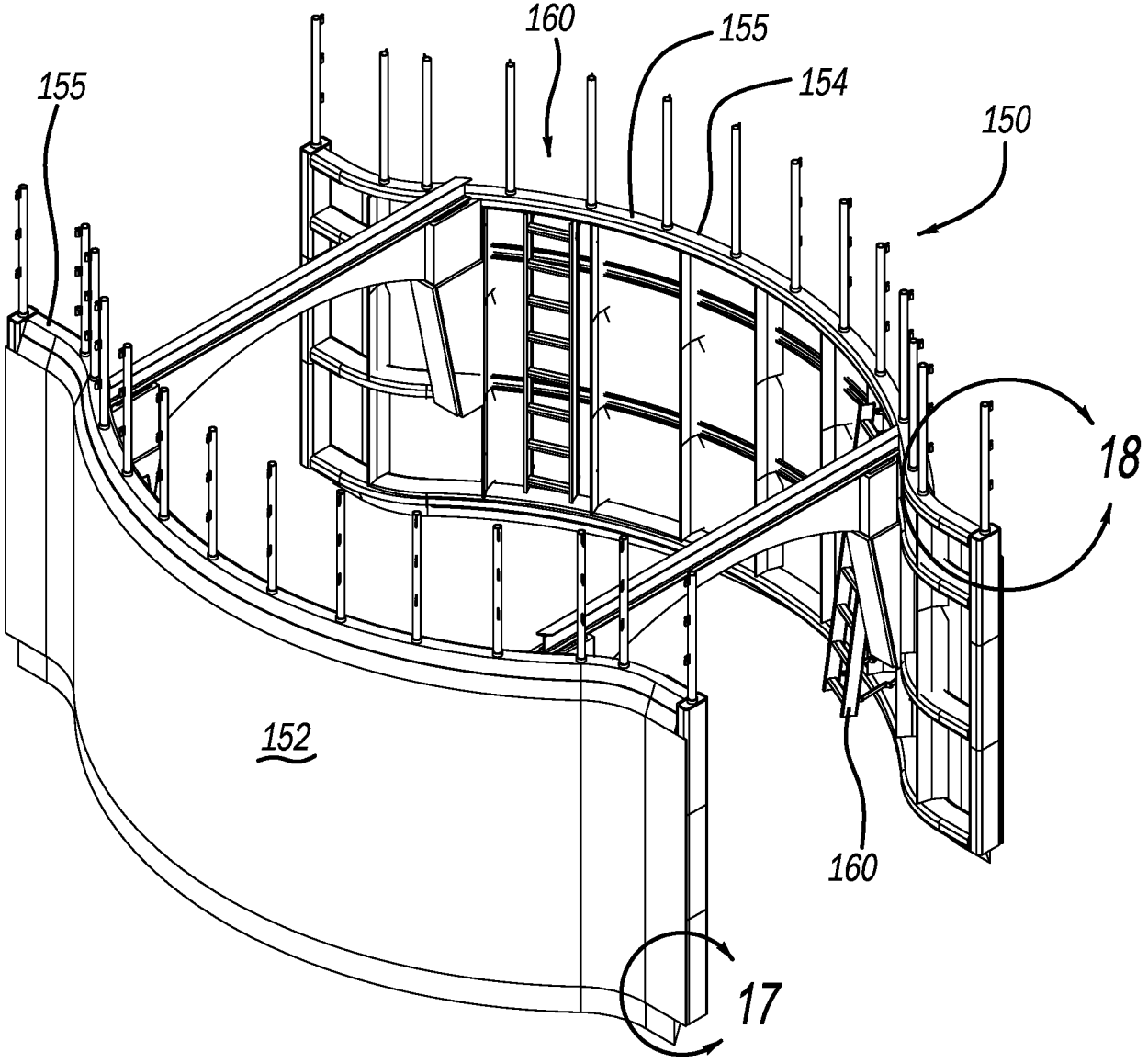
FIG. 16 is a perspective view of another embodiment of a bell hole box having arcuate sides.

FIG. 16 is a perspective view of another embodiment of a bell hole box. From FIG. 16, one can see that bell hole box 150 employs arcuate side wall 152 and arcuate side wall 154 instead of having flat or straight sides that are welded together, joined together, or otherwise angled as depicted in FIG. 1. Also, as depicted in FIG. 16, a ladder 160 may connect at one or multiple locations on either or both of arcuate side wall 152 or arcuate side wall 154. Top frame rail 155 is situated on top of arcuate side wall 154 and arcuate side wall 152.

Figure 17:
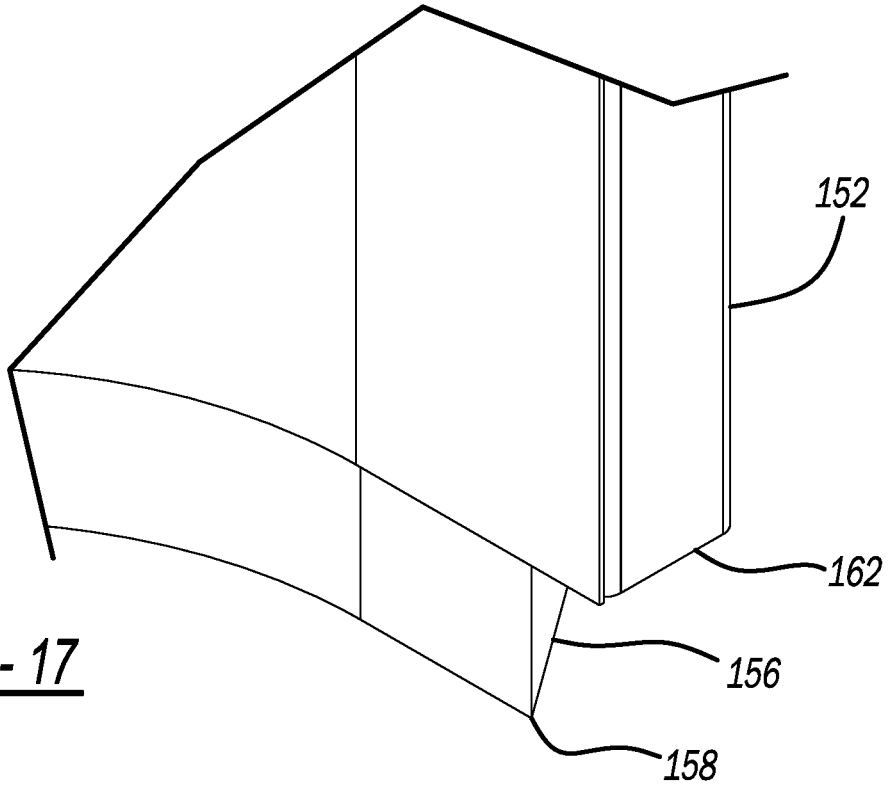
FIG. 17 is an enlarged view of a bottom portion of an arcuate side wall of bell hole box.

FIG. 17 is an enlarged view of a bottom earth-contacting portion of arcuate side wall 152. As an extension piece projecting from bottom surface 162 is a tapered surface 156 that becomes thinner as the distance away from bottom surface 162 becomes greater. At tip 158 of tapered surface 156 is a point of sufficient strength to not bend or break when bell hole box 150 is placed upon an earthen (e.g. dirt, sand, rocky soil) surface, such as in a hole. Bell hole box 150 may then be contacted or hydraulically pressed with a loading machine to ensure that bell hole box 150 will not shift or move under its own weight, such as due to a slightly uneven or wet surface of earth.

Figure 18:
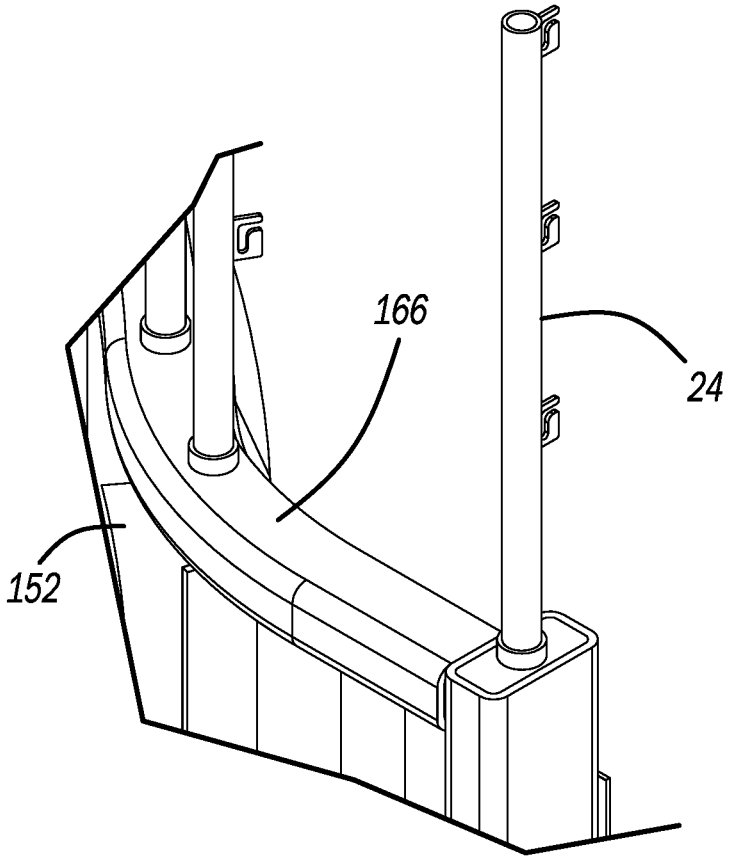
FIG. 18 is an enlarged view of a top portion of an arcuate side wall of bell hole box.

FIG. 18 is an enlarged view of a top rail 166 of an arcuate side wall 152 of bell hole box 150. Installed in top rail 166 is a guard post 24. Safety chains are not depicted in FIG. 18.

Figure 19:
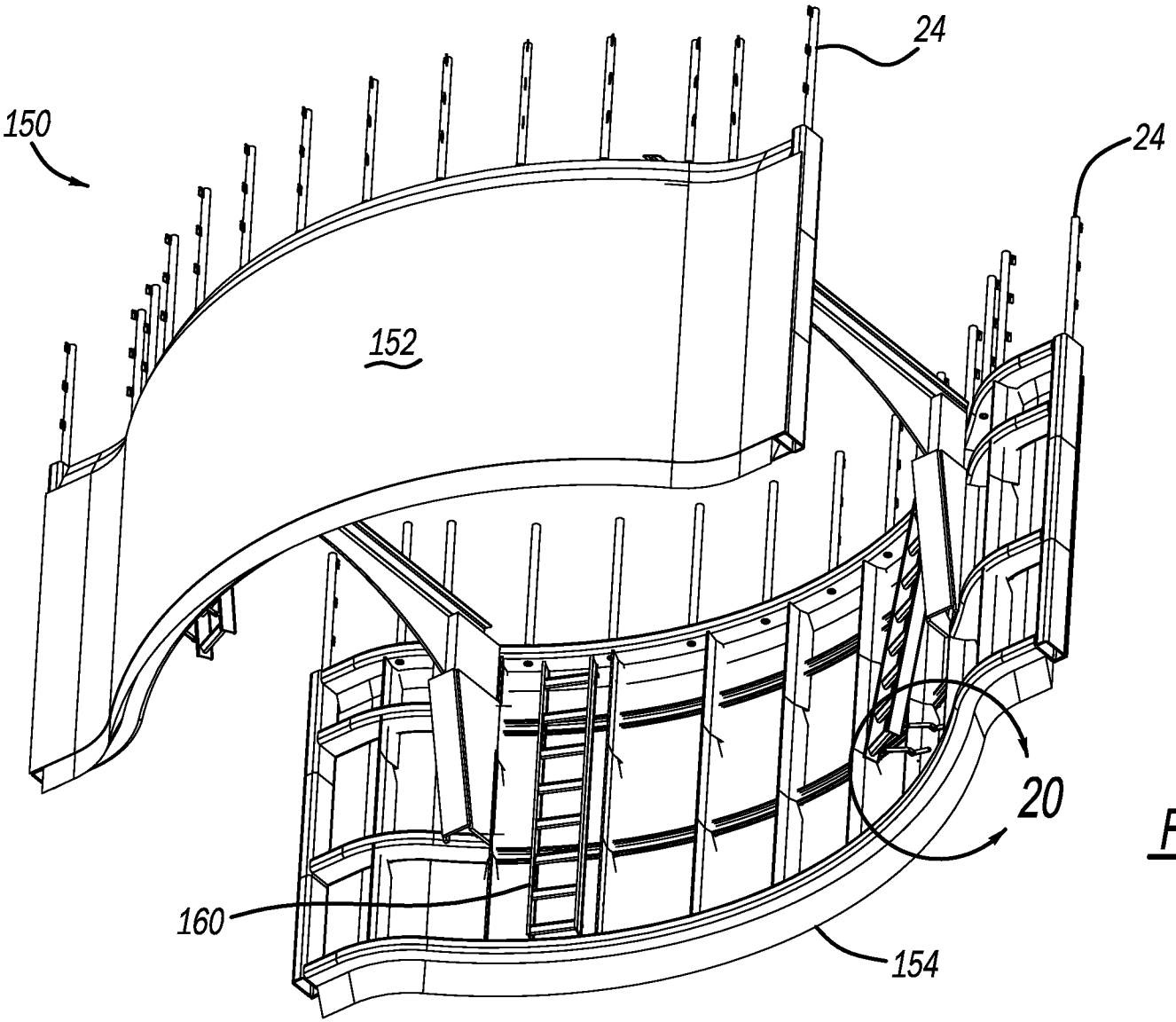
FIG. 19 is a perspective view of a bell hole box with arcuate side walls.

FIG. 19 is a perspective view from underneath bell hole box 150 with arcuate side wall 150 and arcuate side wall 154. Also depicted installed in arcuate side wall 154 is ladder 160 in a position of non-use, and another ladder 160 in a position that is ready for use, which is also shown in the enlarged view of FIG. 20. Ladder 160 depicted in the position of non-use, in which the entirety of ladder 160 is situated against arcuate side wall 154, may be secured with spring clips (not shown) or locking extension bracket 168 (FIG. 20) that is retractable, and similar to, or the same as, a mechanism that may be found on a step ladder that extends at its bottom. At an opposite, top end of ladder 160, simple pins may be passed through rails of ladder 160. Alternatively, hinges may be used on each longitudinal, vertical rail of ladder 160.

Figure 20:
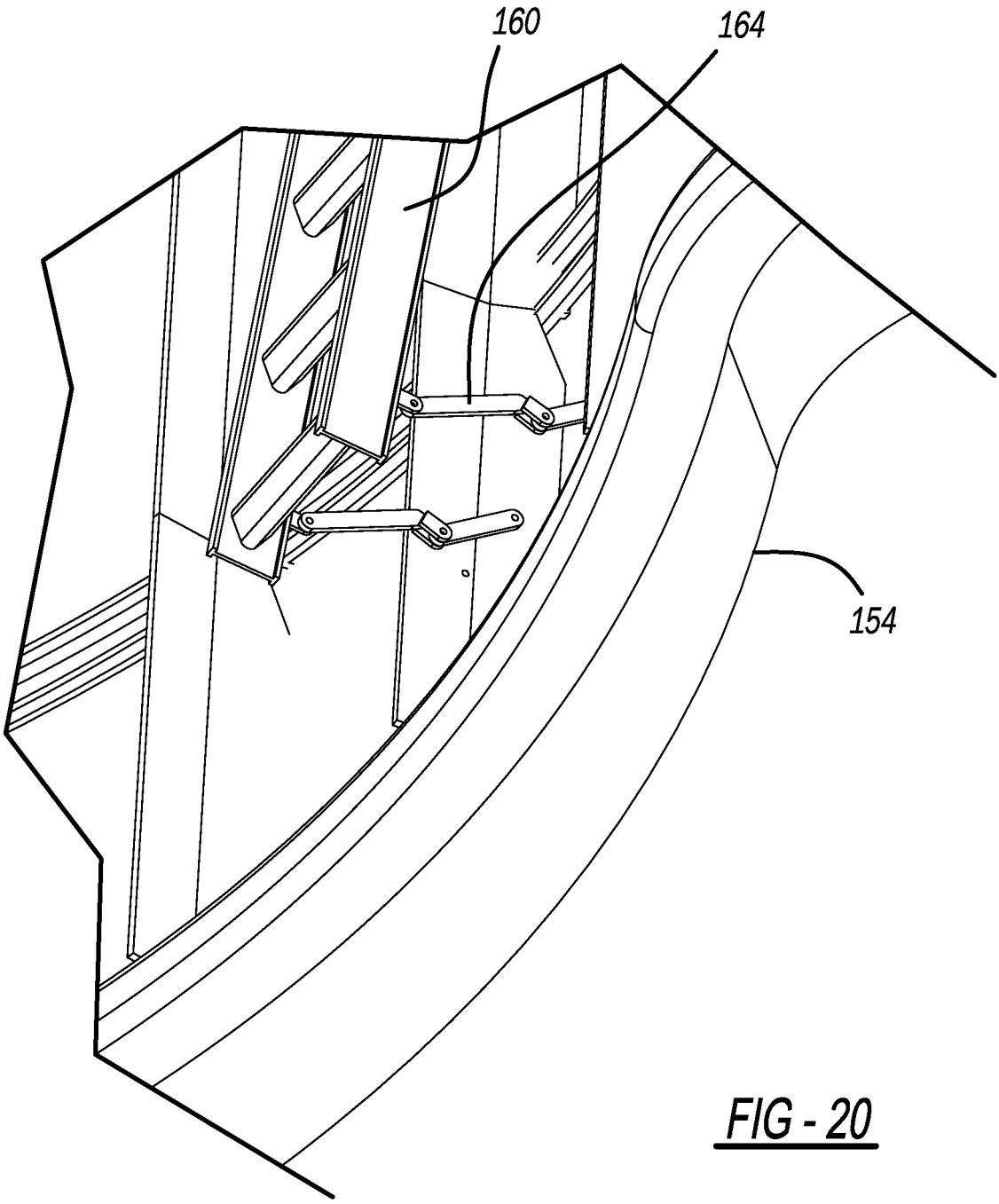
FIG. 20 is an enlarged view of a ladder area of bell hole box with arcuate side walls.

FIG. 20 is an enlarged view of a bottom of ladder 160 and depicts an extension device 164 that locks in an extended position, but that is also retractable to permit ladder 160 to be vertical or substantially vertical and mount completely against arcuate side wall 154.

Figure 21:
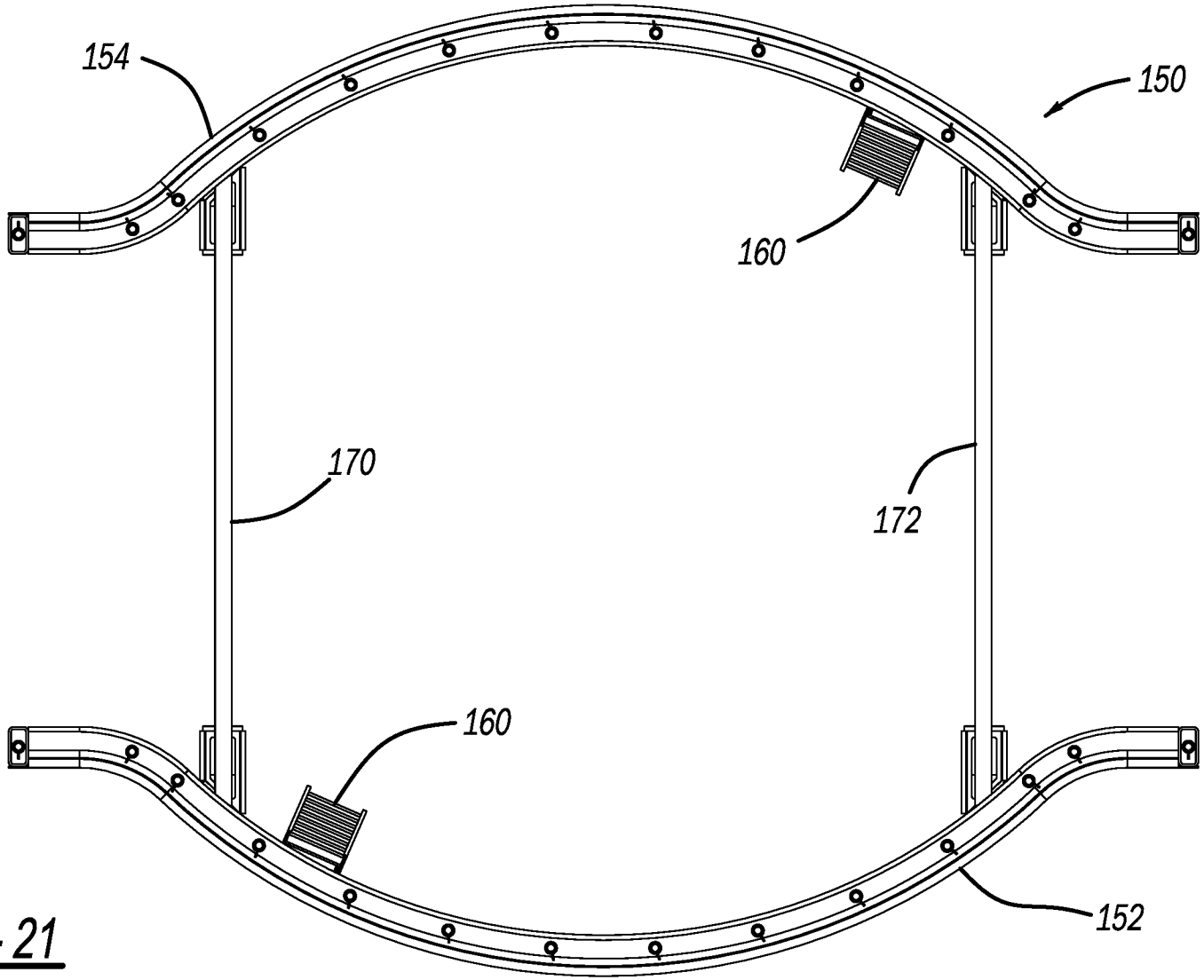
FIG. 21 is a top view of a bell hole box with arcuate side walls.

FIG. 21 is a top view of bell hole box 150 with arcuate side wall 152 and arcuate side wall 154 that also depicts a first spreader 170 and a second spreader 172. Each spreader 170, 172 is connected to each arcuate side wall 152, 154. A ladder 160 is depicted in two possible positions, although positioning a ladder is possible anywhere along arcuate wall 152 and arcuate wall 154. Ladder 160 extends out at its bottom connection point to either arcuate side wall 152, 154 and pivots at its top connection point.

Figure 22:
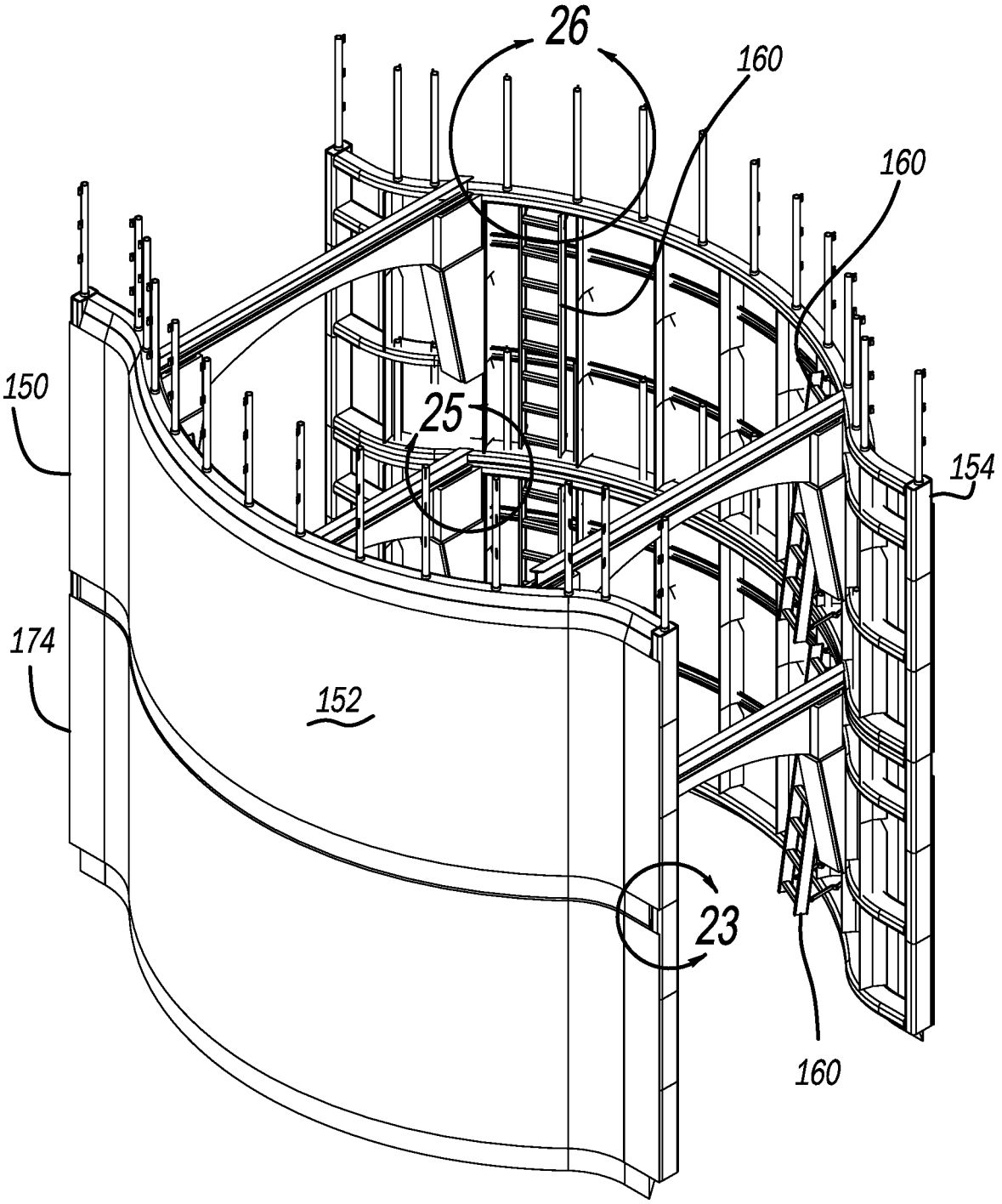
FIG. 22 is a perspective view of a first bell hole box stacked on top of a second bell hole box.

FIG. 22 is a perspective view of a first bell hole box 150 stacked on top of a second bell hole box 174, which have the same wall height. An example wall height is 96 inches (243.84 centimeters), although any wall height is conceivable. Two full size ladders 160 are depicted in two locations. A first location depicts ladders in a stowed or folded position such that ladder 160 is stored flat or substantially flat against arcuate side wall 152. A second location depicts ladders in an extended or in-use position such that ladder 160 is not stored flat or substantially flat against arcuate side wall 152, but rather is extended away from side wall 154 at a bottom end of ladder 160. To facilitate ingress and egress from bell hole boxes 150, 174 only bottom ladder next to an Earthen surface upon which bell hole box 174 resides, will have its ladder 160 extend away from arcuate side wall 154, while ladder 160 in bell hole box 150 stacked directly above bell hole box 174 may be located directly against arcuate side wall 154 or extended slightly to whatever degree facilitates safe ingress and egress. As shown in FIG. 20, extension device 164 of ladder 160 is adjustable. Any ladder 160 of any bell hole box 10, 150, 174 may have a bottom rung that is 6 to 12 inches above the bottom of the wall to which the ladder 160 is mounted.

Figure 23:
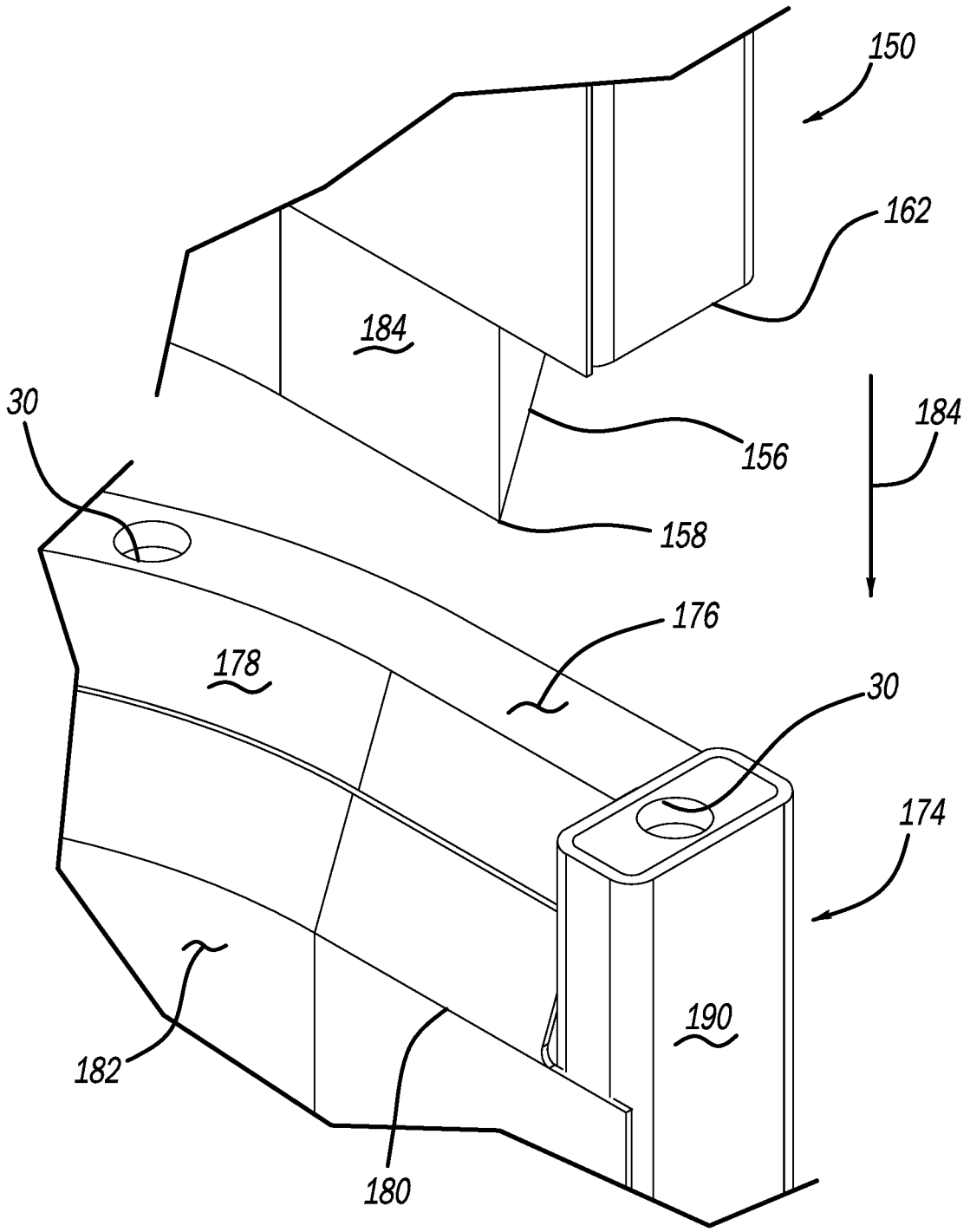
FIG. 23 is an enlarged view of a junction location where a first bell hole box stacks on top of a second bell hole box.

FIG. 23 is an enlarged view of a junction, mating or seating location where a first bell hole box 150 stacks on top of a second bell hole box 174. Junction more specifically entails a bottom flat surface 162 of bell hole box 150 seats against a top flat surface 176 of bell hole box 174 (a bell hole box positioned under or below bell hole box 150). When bottom surface 162 seats with top surface 176, tapered surface 156 seats or contacts surface 178 of bell hole box 174. Holes 30 in any bell hole box 10, 150, 174 may be used as a location to mount a winch or other accessories. Any tapered surface on a bottom of bell hole box 10, 150, 174 may be used to driven into a bottom of a trench.

Figure 24:
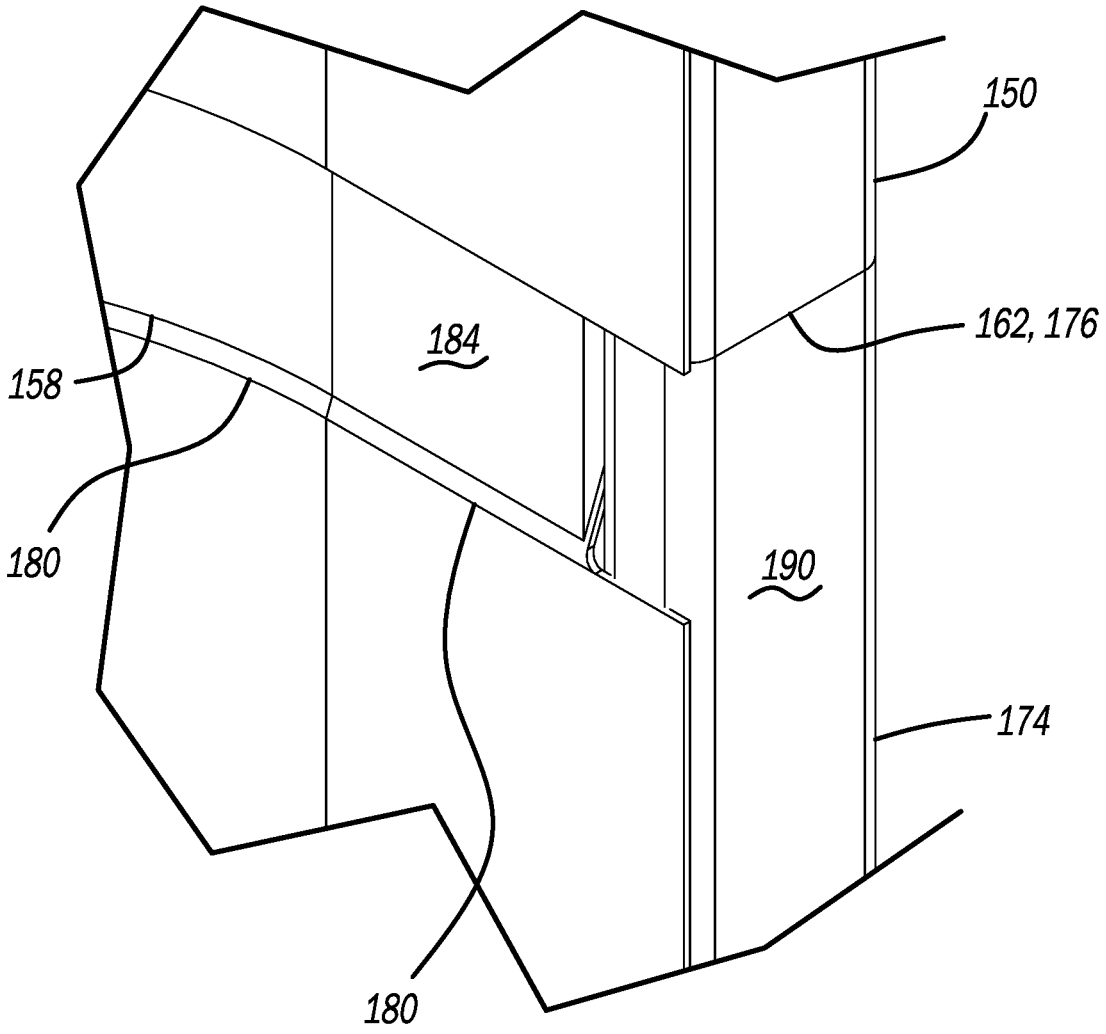
FIG. 24 is an enlarged view of a junction of a first bell hole box stacked on top of a second bell hole box.

FIG. 24 is an enlarged view of a junction of bell hole box 150 stacked on top of bell hole box 174. When bell hole box 150 is lowered in accordance with arrow 184 (FIG. 23), the arrangement of FIG. 24 results with bottom surface 162 of bell hole box 150 contacting top flat surface 176 of bell hole box 174 with tapered surface 156 contacting tapered surface 176. As depicted, tip 158 of protruding wedge portion 184 may not reach an edge 180 of wall 182 of bell hole box 174. As depicted, when mated or joined, protruding wedge portion 184 of bell hole box 184 will fit inside vertical side support frame 190.

Figure 25:
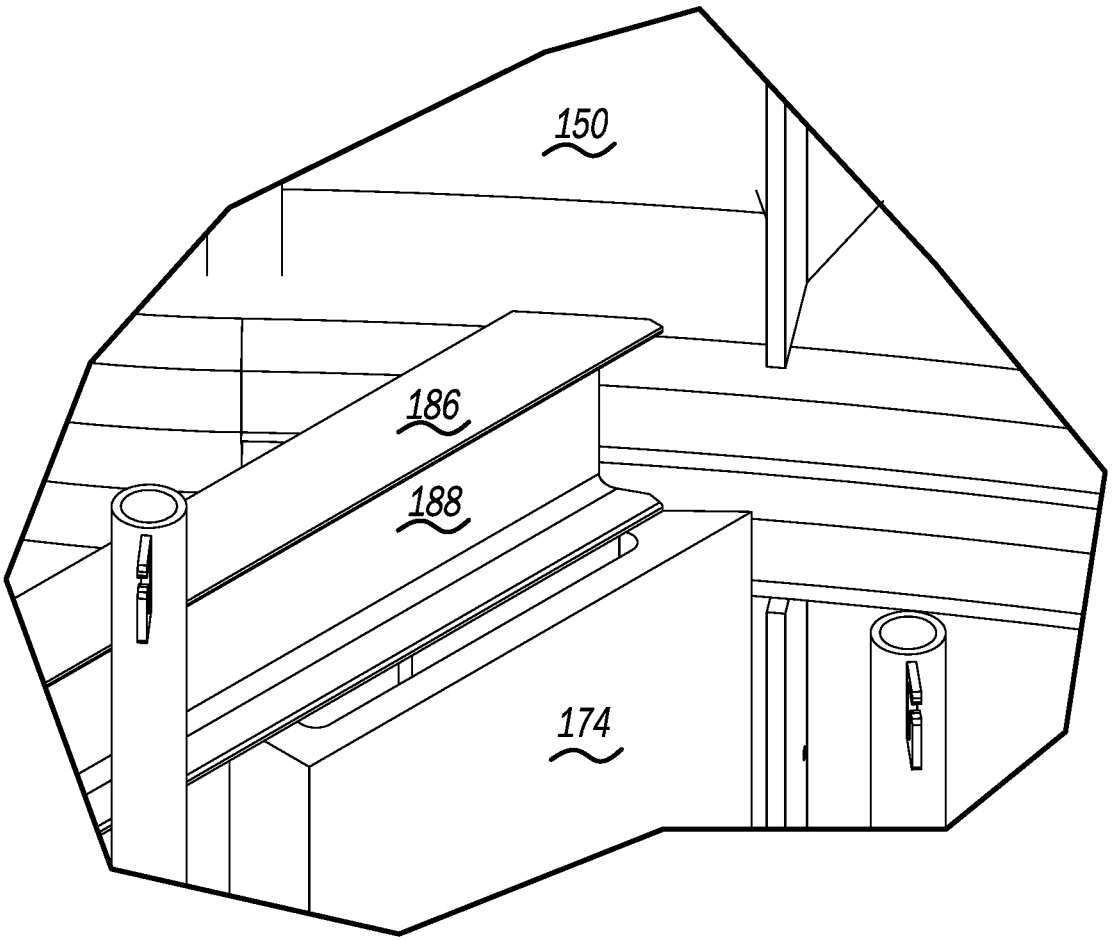
FIG. 25 is an enlarged view of a junction of a first bell hole box stacked on top of a second bell hole box.

FIG. 25 is an enlarged view of a junction of first bell hole box 150 stacked on top of second bell hole box 174 depicting top plate 186 and an end of spreader 188 contacting a bottom of bell hole box 150, that is, the upper bell hole box in the arrangement of FIG. 25.

Figure 26:
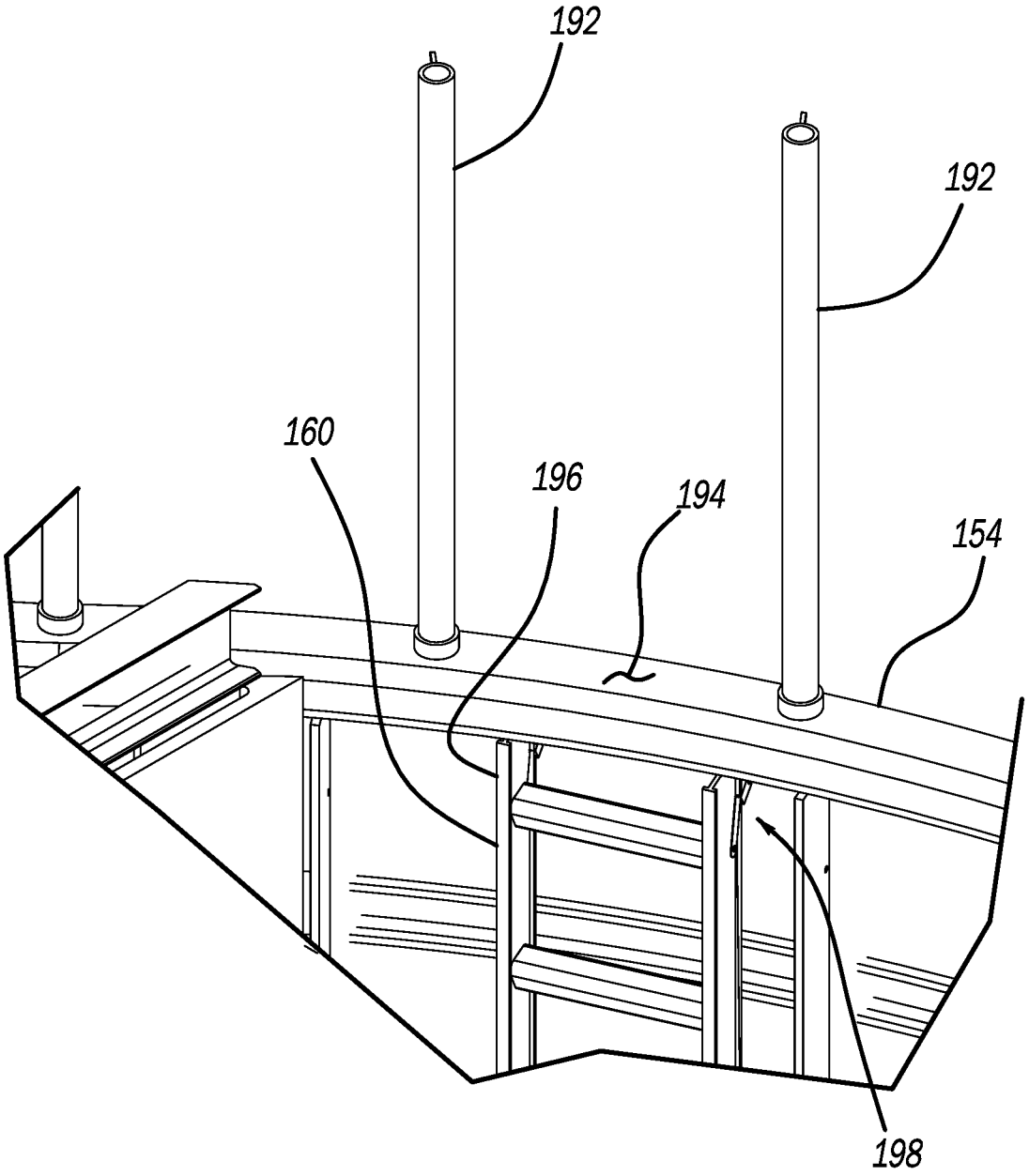
FIG. 26 is an enlarged view of an ingress and egress location of bell hole box.

FIG. 26 is an enlarged view of an ingress and egress location of bell hole box 150. Guard rail posts 192 will fit within holes in top rail 194 at the location of guard rail posts 192. Extensions to ladder sides may be added as part of guard rail posts 192 and reside above a top end 196 of ladder 160 (not shown). Ladder 160 may or may not pivot about point 198 at top of ladder 160.

Figure 27:
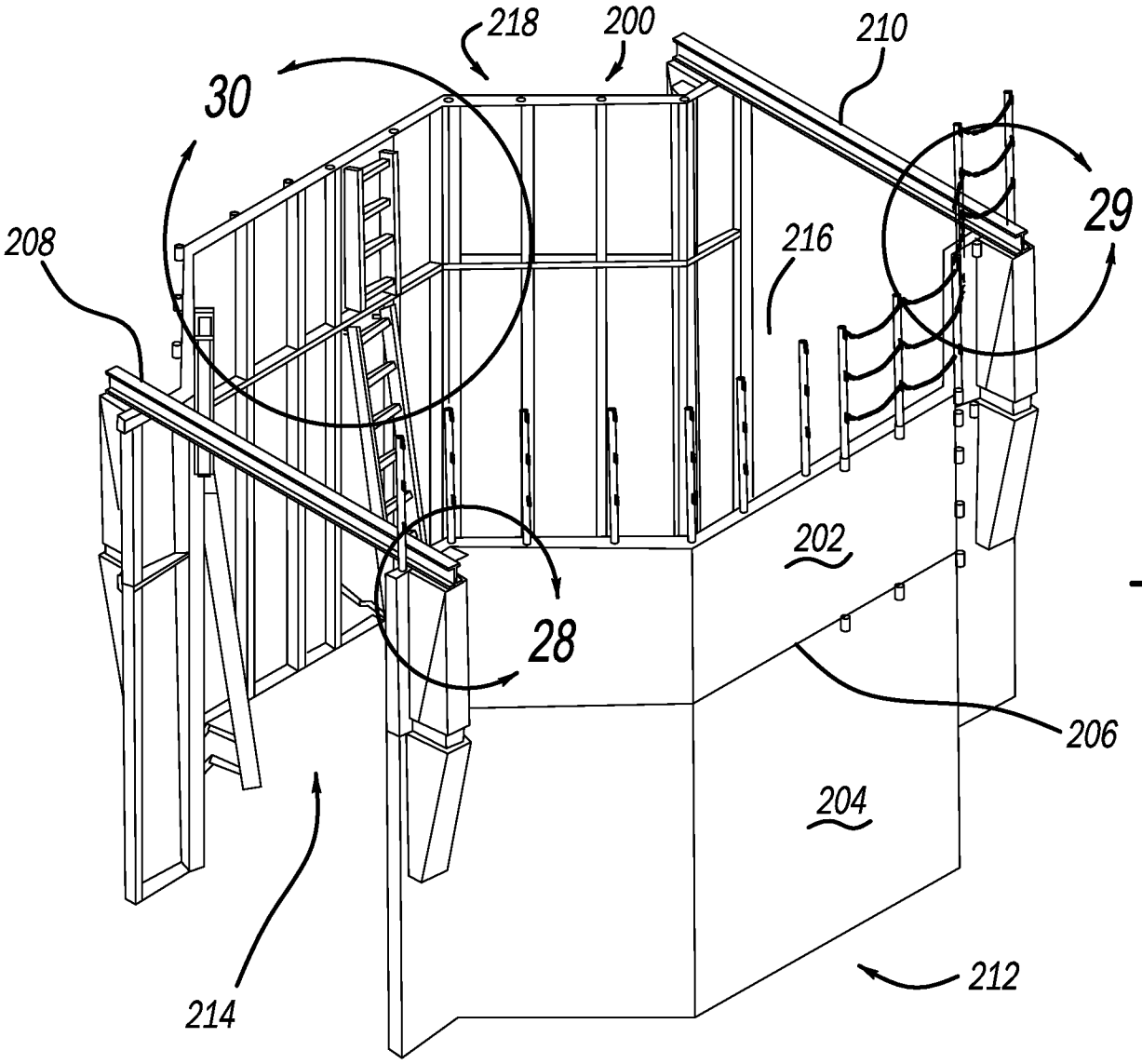
FIG. 27 is a perspective view of a first bell hole box stacked on top of a second bell hole box depicting an example location of ladders for ingress and egress.

FIG. 27 is a perspective view of another embodiment of a bell hole box 200. As an example, bell hole box 200 may be an assembly of a top bell hole box 202 and a bottom bell hole box 204 such that top bell hole box 202 has a wall height that is less than a wall height of bottom bell hole box 204. A mating, junction or contact plane 206 is where top bell hole box 202 and bottom bell hole box 204 contact and form bell hole box 200. A first separator 208 and a second separator 210 may be used to maintain a prescribed distance between, and secure a first wall 212 of bottom bell hole box 204, a second wall of bottom bell hole box 204, a first wall 216 of top bell hole box 202 and a second wall of top bell hole box 202.

Figure 28:
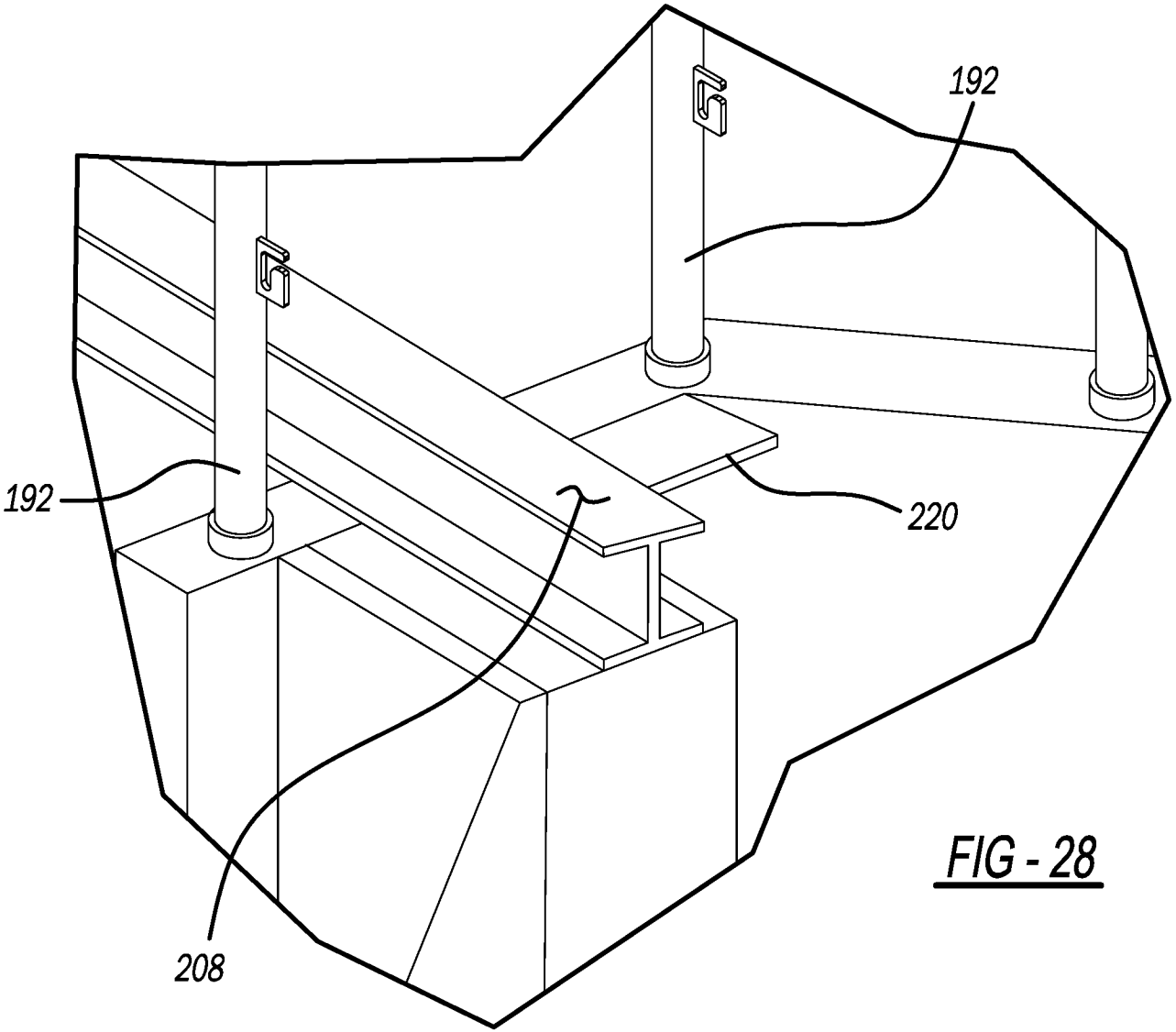
FIG. 28 is an enlarged view of an upper location of an upper bell hole box when the upper and first bell hole box is stacked on top of a lower and second bell hole box.

FIG. 28 is an enlarged view of an upper location of top bell hole box 202 when top bell hole box 202 and is stacked on top of bottom bell hole box 204. Next to first spreader 208 is a winch mounting 220, which may be used for mounting part of a winch or connecting an end of a winch cable to use to lift top bell hole box 202 from bottom bell hole box 204, or to lift the entire bell hole box 200.

Figure 29:
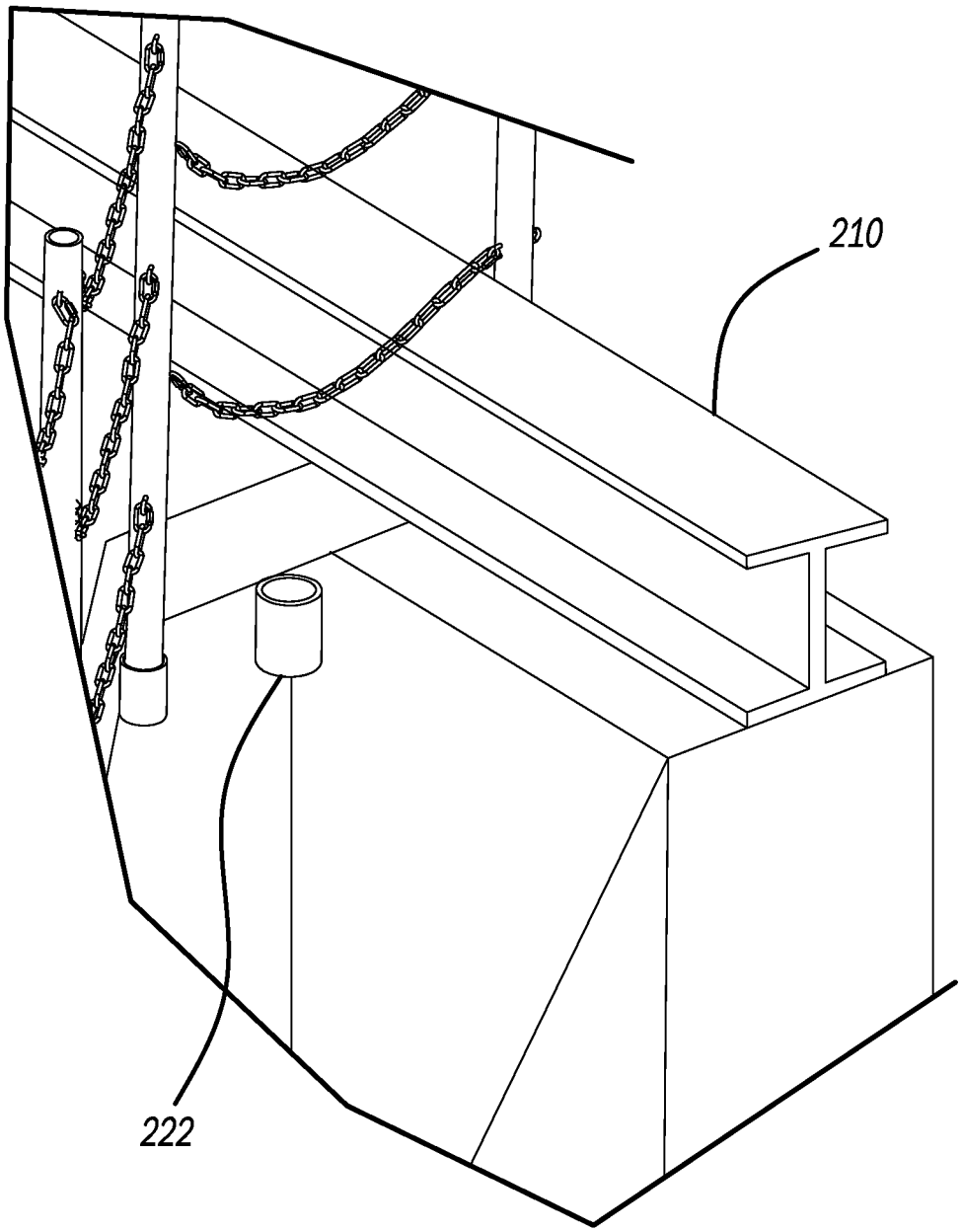
FIG. 29 is an enlarged view of an upper location of an upper bell hole box when the upper and first bell hole box is stacked on top of a lower and second bell hole box.

FIG. 29 is an enlarged view of an upper location of top bell hole box 202 when top bell hole box 202 is stacked on top of bottom bell hole box 204. Next to second spreader 210 is a winch mounting 222, which may be used for mounting part of a winch or connecting an end of a winch cable to use to lift top bell hole box 202 from bottom bell hole box 204, or to lift the entire bell hole box 200. Winch mount 222 depicted as part of FIG. 29, may be an alternative to winch mount 220 of FIG. 28.

Figure 30:
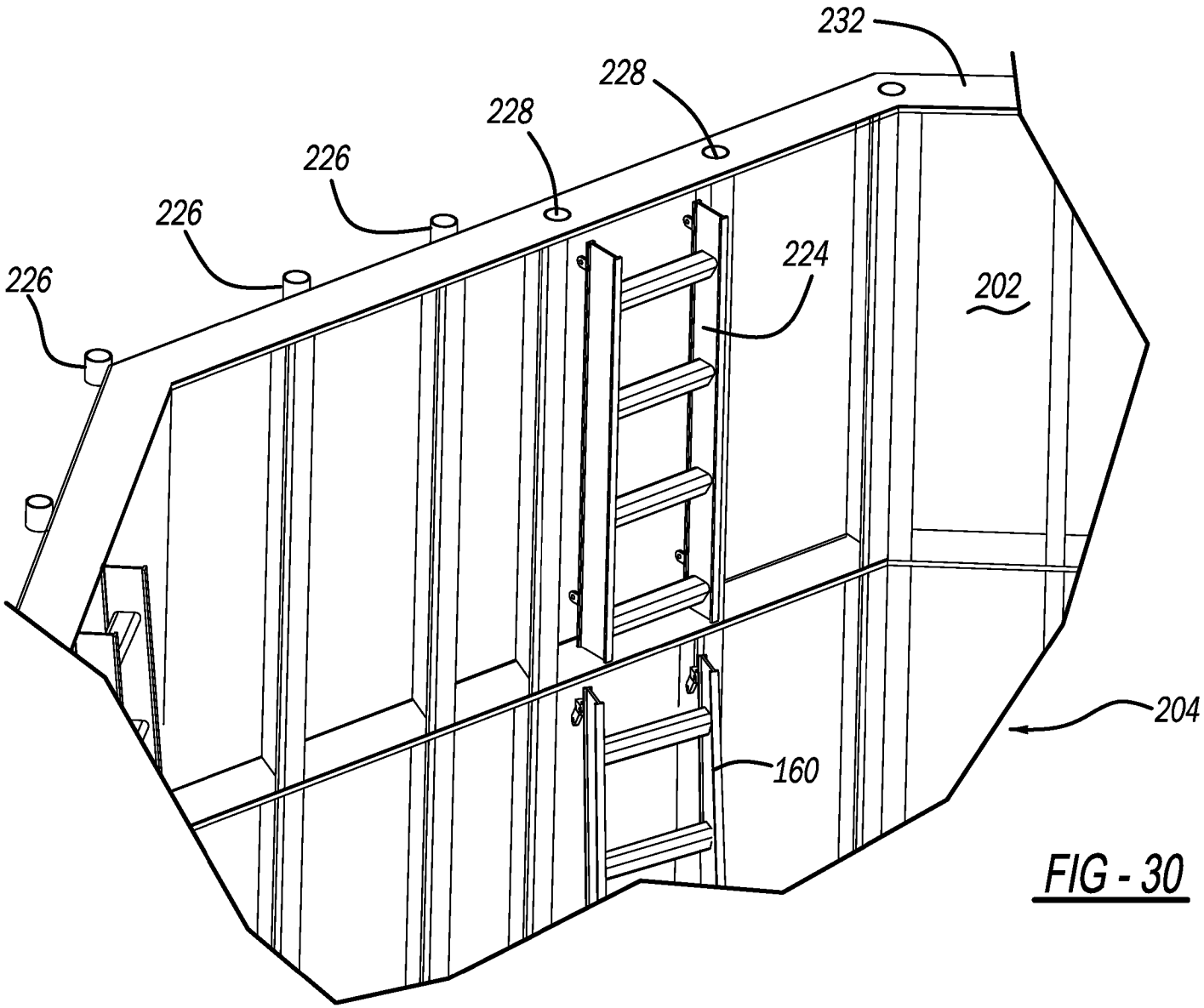
FIG. 30 is an enlarged view of a junction of a first bell hole box when stacked upon a second bell hole box, and depicting a location of multiple ladders, with holes for railing posts or guard posts.

FIG. 30 is an enlarged view of an upper location of top bell hole box 202 when top bell hole box 202 is stacked on top of bottom bell hole box 204. Depicted above ladder 160, which may be mounted and operated similarly to other ladders 160 installed in bottom bell hole boxes, such as described in conjunction with FIG. 16, for example, is a ladder 224 which may be shorter than ladder 160. Also resident along a top surface 232 of top bell hole box 202 is stake or post pocket 226 within which may reside a stake or post 230 (FIG. 27), with safety chains connecting the posts 230. Instead of stake or post pocket 226 residing on an outside surface of top bell hole box 202, stake or post pocket 228 may reside within top surface 232 of top bell hole box 202.

Figure 31:
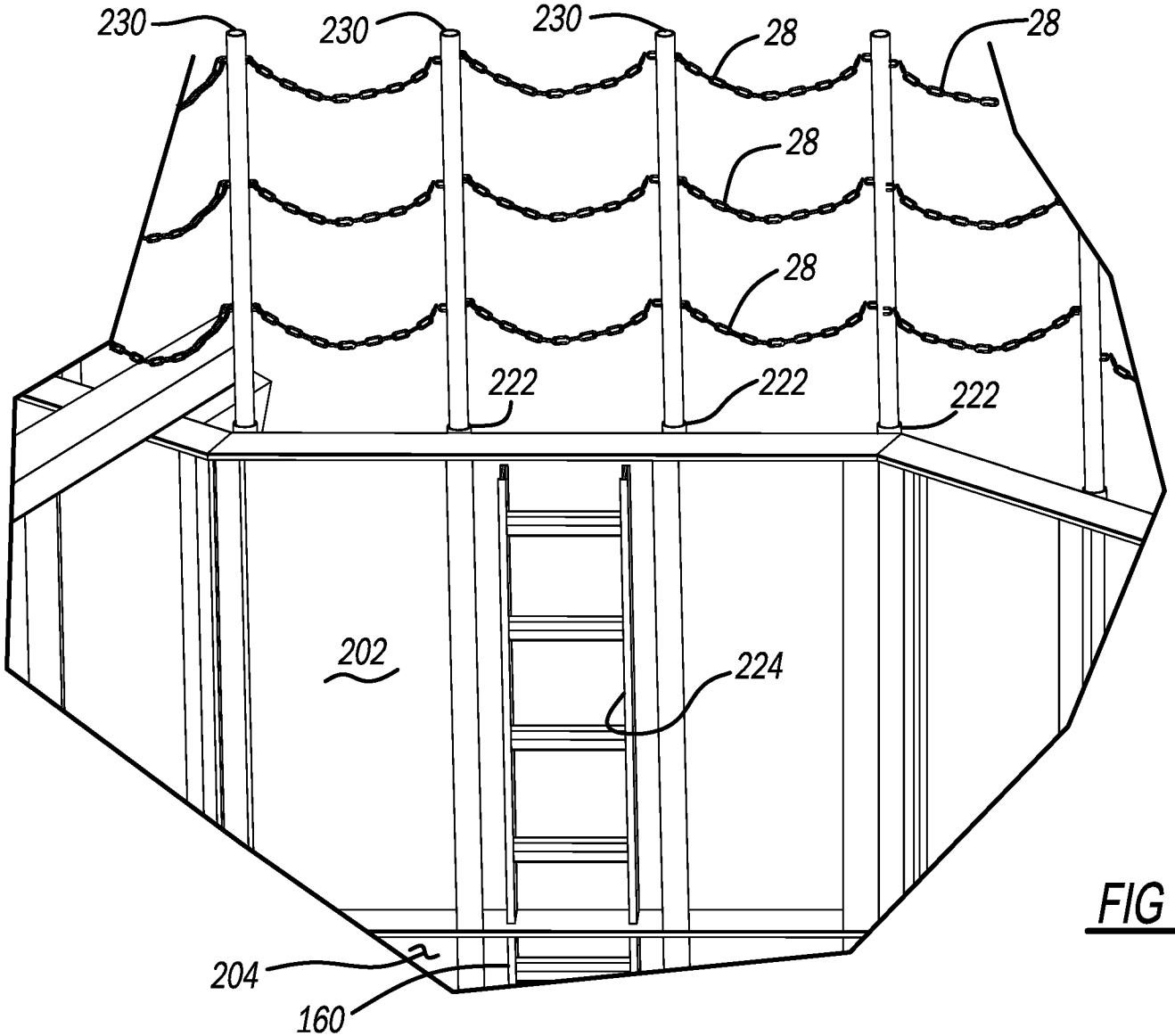
FIG. 31 is a an enlarged view of a junction of a first bell hole box when stacked upon a second bell hole box, and depicting a location of multiple ladders, with safety chains installed between railing posts or guard posts.
Figure 32:
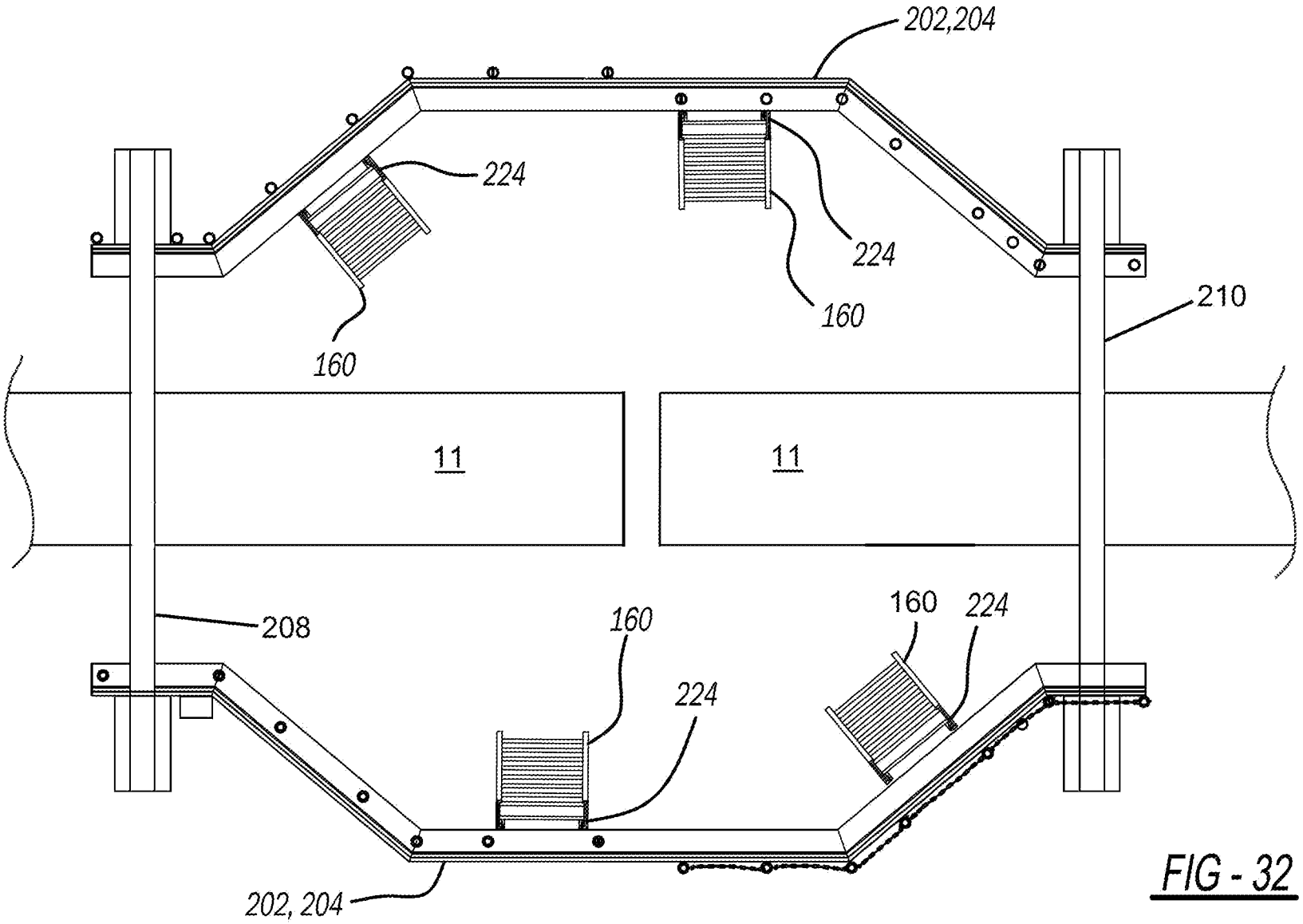
FIG. 32 is a top view of a first bell hole box stacked on top of a second bell hole box depicting example locations for multiple ladders in a stacked configuration.

FIG. 31 is an enlarged view of top bell hole box 202 when top bell hole box 202 is stacked on top of bottom bell hole box 204. A location of shortened ladder 224 above ladder 160, with safety chains 28 installed between railing posts or guard posts 230. FIG. 32 is a top view of top bell hole box 202 stacked on top of bottom bell hole box 204 depicting example locations for multiple ladders 160, 224 around an interior of bell hole box 200.

In any of the embodiments described above, a ladder 160, 224 may be attached to an interior surface of a box wall or arcuate wall such that a top of the ladder 160, 224 may pivot to permit a bottom of the ladder 160, 224 to move away from the wall to permit a worker to enter and exit the specific bell hole box to which the ladder 160, 224 is attached. An extension device may be attached at the bottom of the ladder 160, 224 to permit the ladder 160, 224 to be movable to a swung-out position away from a wall to which the ladder 160, 224 is attached. A locking mechanism built into the extension device 164 may be employed to lock the ladder 160, 224 in an extended position away from the wall to which it is attached. The wall may be straight (e.g. flat) or arcuate (e.g. curved). The ladder may attach to a wall panel or a vertical or horizontal structural member that supports the wall panel. Welding or loose fasteners may be employed to attach the ladder. The walls of a bottom bell hole box and a top bell hole box may be made of linear sections to form a working space within the bottom bell hole box and the top bell hole box that is eight sided, including straight sections of both spreader bars.

Figure 33:
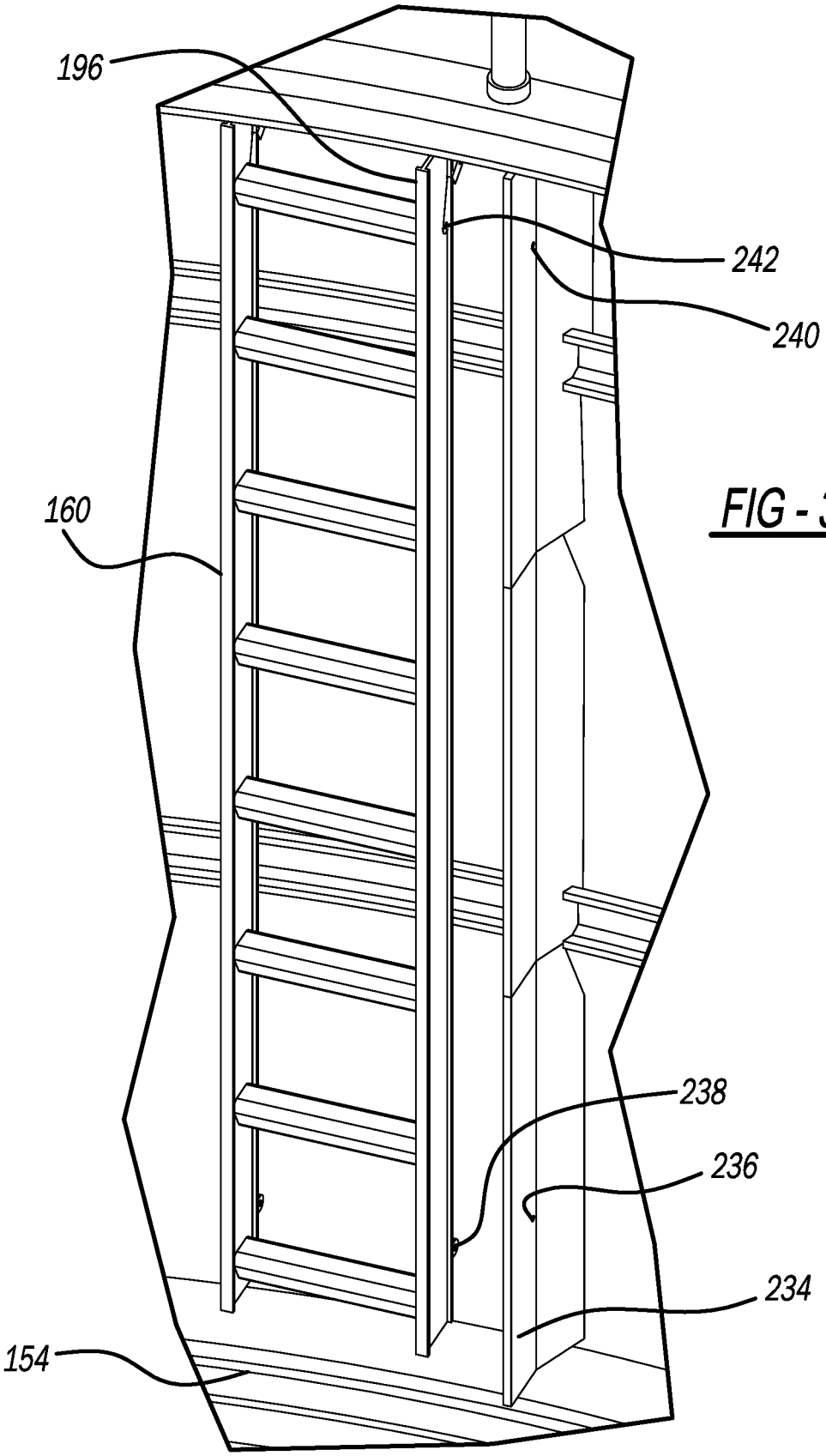
FIG. 33 is a perspective view of a ladder in its near-installed position next to an interior surface of a wall of a bell hole box.

FIG. 33 is an enlarged perspective view of ladder 160 residing in its near-installed position next to an interior surface of a wall of a bell hole box. When installed, ladder 160 in one embodiment will be securely fastened to vertical post 234 using hole 236 in post 234, and hole 238 in a longitudinal rail of ladder 240, with a fastener such as a bolt passing through both holes 236, 238 to secure ladder adjacent or against an interior surface of a wall of bell hole box. A similar fastening arrangement may exist at a top end 196 of ladder. That is, a fastener may pass through both, a hole 240 of post 234 and a hole 242 at a top end 196 of ladder rail of ladder 160. Fasteners are not depicted in FIG. 33.

Figure 34:
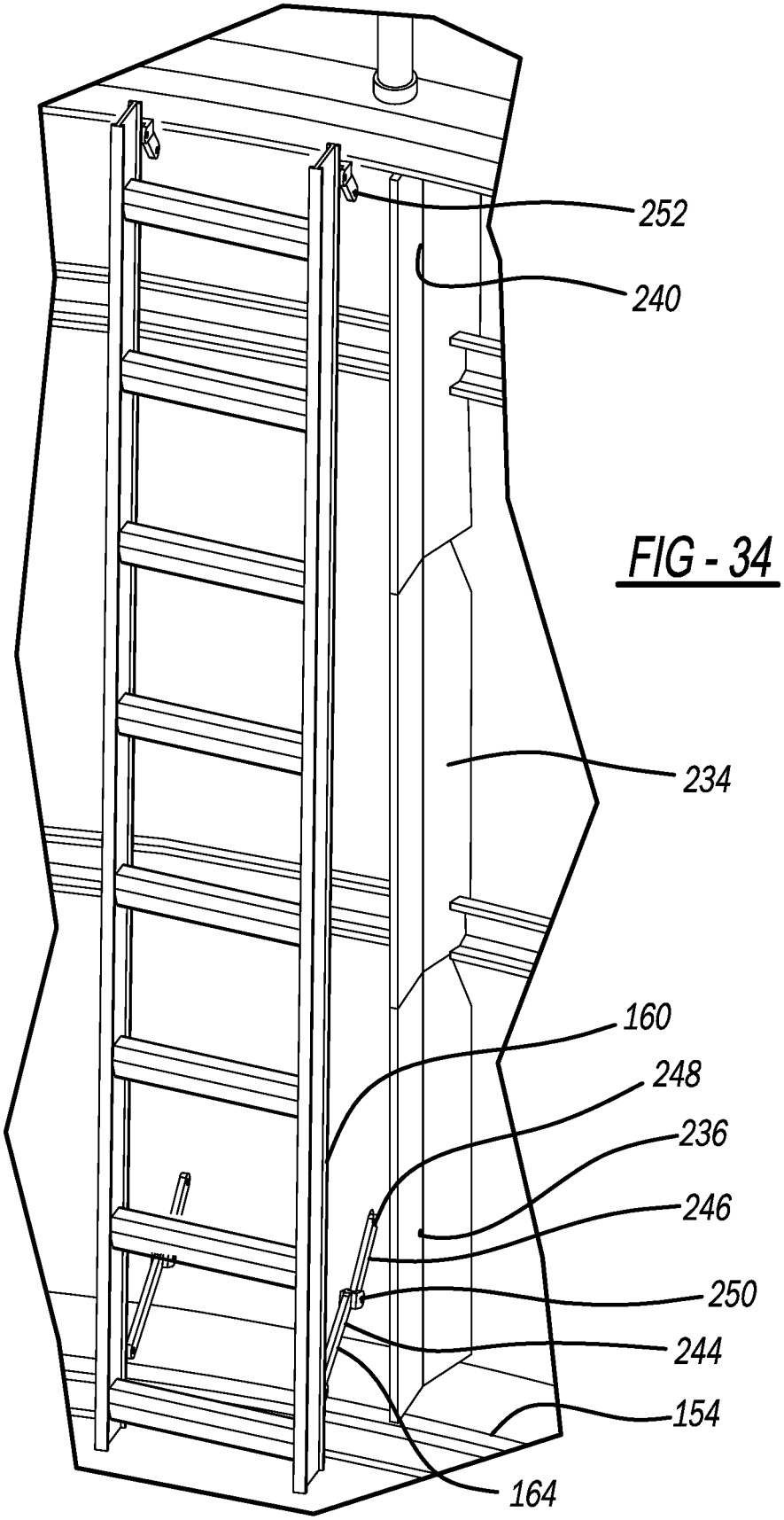
FIG. 34 is a perspective view of a ladder in its near-installed position next to an interior surface of a wall of a bell hole box, the ladder exhibiting example linkages used mount the ladder to the interior support structure of the bell hole box.
Figures 35, 36:
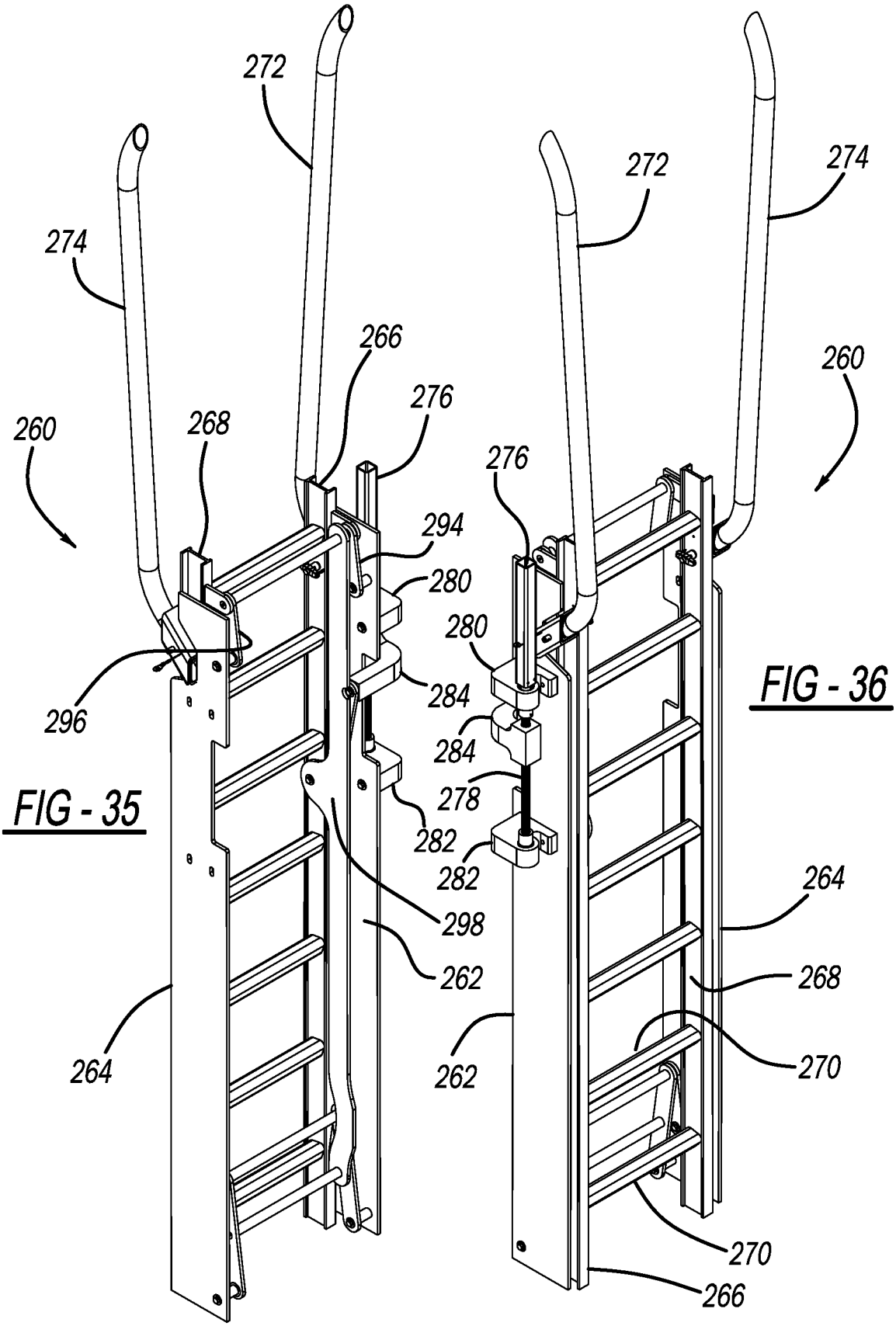
FIG. 35 is a perspective view of a ladder that is mountable to the interior support structure of the bell hole box.
FIG. 36 is a perspective view of a ladder that is mountable to the interior support structure of the bell hole box.
Figure 37:
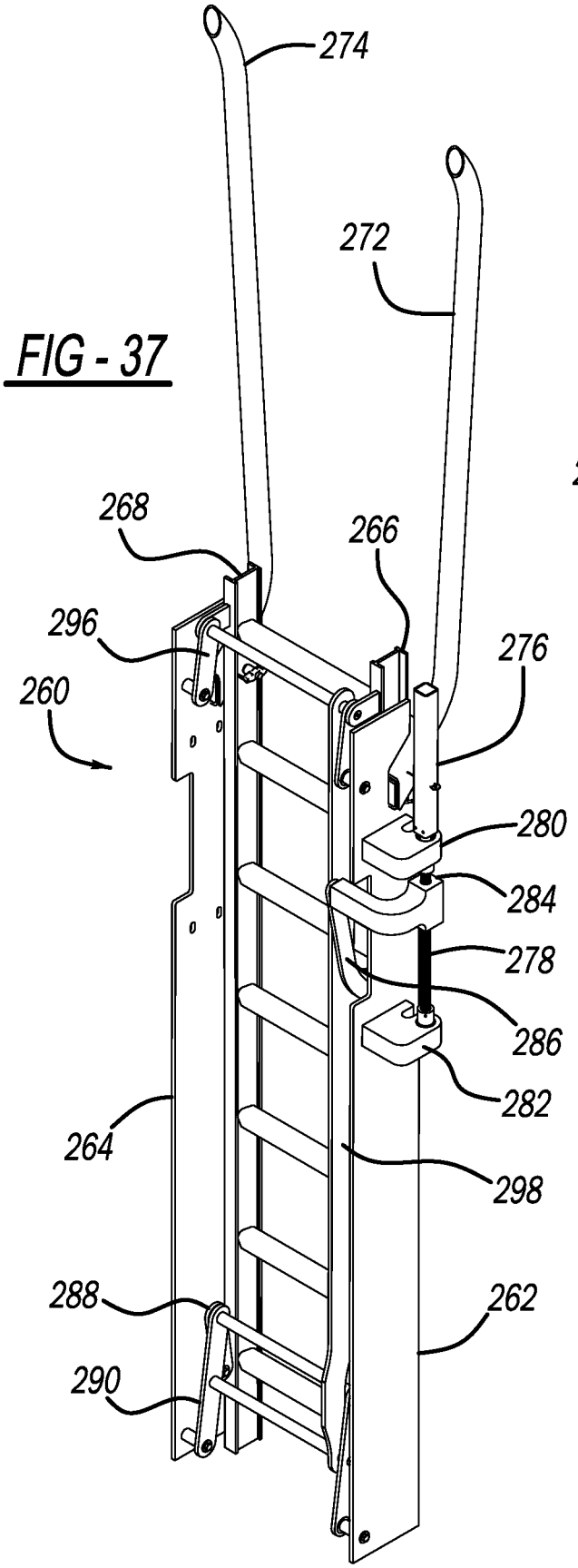
FIG. 37 is a perspective view of a ladder that is mountable to the interior support structure of the bell hole box.
Figure 38:
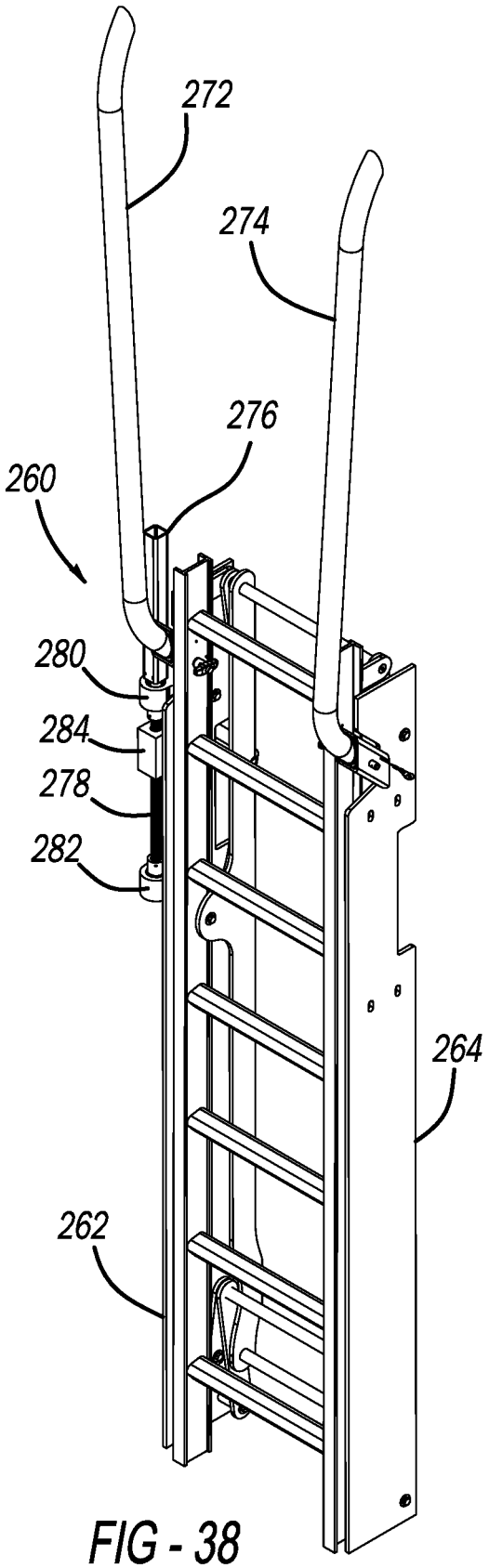
FIG. 38 is a perspective view of a ladder that is mountable to the interior support structure of the bell hole box.

FIG. 34 is an enlarged perspective view of ladder 160 in its near-installed position next to an interior surface of a wall of a bell hole box. However, in this embodiment, as also depicted in FIG. 20, ladder 160 may exhibit an extension device 164 that may be made up of a first bar 244 and a second bar 246 that are connected with a pin 250. A hole 248 in second bar 246 may be made to align with hole 236 in post 234 to securely mount the ladder to the interior of the bell hole box. Similarly, a bar 252 may be a connector between post 234 and ladder 160, by connecting to each of post 234 and ladder 160 by using a traditional fastener such as a bolt (not shown). Because at least a single bar 252 is used at the top of ladder 160 and bar 252 is able to pivot at each of its ends, one end of bar 252 relative to ladder 160 and the other end of bar 252 relative to post 234, bottom ends or feet of ladder 160 are able to contact the earth or floor of whatever the bell hole box is resting upon when in its in-use position, and bottom ends or feet of ladder 160 are able to store against or adjacent an interior wall of bell hole box when ladder 160 is lifted or moved to its stowed position. Ladder 160 may be stored at one or more positions about interior of a bell hole box, as depicted in FIG. 32 and FIG. 21.

FIGS. 35-38 each depict a perspective view of a ladder assembly 260 that is mountable to the interior support structure of the bell hole box. Ladder assembly 260 is a combination of parts that permit safe entry into and exit from bell hole box 150, for example, as depicted in FIG. 16. Ladder assembly 260 can be considered a type of automated version of a ladder compared to a ladder that is merely bolted to an interior surface of bell hole box as depicted in FIG. 16. FIGS. 35-38 depict ladder assembly 260 having a first ladder support 262, a second ladder support 264, a first ladder rung support 266, and a second ladder rung support 268. First ladder rung support 266 and second ladder rung support 268 are parallel members and are each directly connected to numerous ladder rungs 270 along the lengths of first ladder rung support 266 and second ladder rung support 268. Ladder rungs 270 are located between first ladder rung support 266 and second ladder rung support 268. First ladder rung support 266 and second ladder rung support 268 are located between first ladder support 262 and second ladder support 264. First ladder support 262, second ladder support 264, first ladder rung support 266, and second ladder rung support 268 all may be parallel to each other. Attached to first ladder support 262 is a first handle bar 272, and attached to second ladder support 264 is a second handle bar 274. Each of first handle bar 272 and second handle bar 274 protrude above ladder assembly 260, and also protrude above a top rail of any bell hole box to which ladder assembly is fastened or installed, so that a human hand may grasp either. First ladder rung support 266 and second ladder rung support 268, along with connecting rungs 270 are located inside, in between, or inboard of first ladder support 262 and second ladder support 264.

FIGS. 35-38 also each depict a rotatable crank guide 276, which is attached to a threaded drive rod 278, which is journaled or held in place by an upper drive rod mount 280, and a lower drive rod mount 282. Drive rod 278 is threaded and passes through a curved drive link 284. Because upper drive rod mount 280 and lower drive rod mount 282 are both securely fastened to first ladder support 262, curved drive link moves upward and downward because the hole in curved drive link 284 is threaded, and its threads engage the mating threads of drive rod 278. Thus, when ladder assembly 260 is securely fastened to an internal wall of trench box 150 of FIG. 19, and crank guide 276 is turned clockwise, for example, curved drive link 284 moves downward away from upper drive rod mount 280 which causes bottom of ladder to pivot outwardly and away from an interior wall of bell hole box 150 and into the position depicted in FIG. 19 and FIG. 20.

More specifically, and with continued reference to FIGS. 35-38 when crank guide 276 is turned clockwise and curved drive link 284 moves downward away from upper drive rod mount 280, curved drive link 284 also drives curved ladder link 286 downward and outward away from first ladder support 262 and second ladder support 264, while bottom ladder short link 288 and bottom ladder long link 290 (FIG. 37) begin to move generally away from first ladder support 262 and second ladder support 264, as depicted in FIG. 19 and FIG. 20. Similarly, first upper ladder link 294 and second upper ladder link 296 are also driven in a similar direction away from an interior bell hole box wall as bottom rung moves away from the interior wall. Because curved ladder link 286 (FIG. 37) is attached to a longitudinal ladder link 298 (FIG. 35), which is directly or indirectly attached to first upper ladder link 294 and bottom ladder short link 288, the rungs 270 attached to first ladder rung support 266 and second ladder rung support 268 are extended and settled in a non-vertical fashion as depicted in FIGS. 19, 20 and 22, which makes them climbable by a person.

Any part depicted in any embodiment of FIGS. 1-38, whether or not enumerated or discussed in this written specification, may be mounted, attached to, or incorporated into another embodiment when such part is not depicted in that other embodiment. For example, ladder 160 depicted in FIGS. 16, 19, 22, 27 and 32 may be mounted, adapted into or otherwise installed into bell hole box 10 depicted in FIG. 1. Moreover, each and every claim below is hereby incorporated into this detailed description or specification as additional embodiments of the present invention. Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. An apparatus for protecting workers working on a pipeline down in a bell hole defined below a surface of the Earth, the apparatus comprising:

a first unitary and concave box wall;

a second unitary and concave box wall opposing the first unitary and concave box wall;

wherein the first unitary and concave box wall terminates in two end panels;

wherein the second unitary and concave box wall terminates in two end panels;

wherein the two end panels of the first unitary and concave box wall are parallel to the two end panels of the second unitary and concave box wall;

a first spreader connected between the first unitary and concave box wall and the second unitary and concave box wall;

a second spreader connected between the first unitary and concave box wall and the second unitary and concave box wall;

wherein the end panels of the first unitary and concave box wall are coplanar, and the end panels of the second unitary and concave box wall are coplanar;

wherein the first unitary and concave box wall and the second unitary and concave box wall are mirror images of each other;

wherein the first spreader and the second spreader permit passage of the pipeline thereunder;

wherein a longitudinal direction of both the first unitary and concave box wall and the second unitary and concave box wall is generally parallel to a longitudinal direction of the pipeline;

wherein a length of the first spreader and a length of the second spreader are equal, and the length of the first spreader and the second spreader is less than a distance defined between a midpoint of the first unitary and concave box wall and a midpoint of the second unitary and concave box wall;

wherein at least a portion of the first spreader contacts the first unitary and concave box wait and the second unitary and concave box wall;

wherein the first unitary and concave box wall is constructed of three straight panels positioned between and terminating in the two end panels of the first unitary and concave box wall;

wherein the second unitary and concave box wall is constructed of three straight panels positioned between and terminating in the two end panels of the second unitary and concave box wall;

a first spreader receiver assembly defining a hollow cavity, the first spreader receiver assembly attached to the first unitary and concave box wall;

a second spreader receiver assembly defining a hollow cavity, the second spreader receiver assembly attached to the second unitary and concave box wall, wherein at least a portion of the first spreader occupies the hollow cavity of the first spreader receiver assembly and at least a portion of the first spreader occupies the hollow cavity or the second spreader receiver assembly;

a third spreader receiver assembly defining a hollow cavity, the third spreader receiver assembly attached to the first unitary and concave box wall;

a fourth spreader receiver assembly defining a hollow cavity, the fourth spreader receiver assembly attached to the second unitary and concave box wall, wherein at least a portion of the second spreader occupies the hollow cavity of the third spreader receiver assembly and at least a portion of the second spreader occupies the hollow cavity or the fourth spreader receiver assembly;

wherein the first spreader and the second spreader are parallel;

wherein together, the first spreader, the second spreader, the first unitary and concave box wall, and the second unitary and concave box wall form an eight-sided structure;

wherein the eight-sided structure is an octagon;

a first spreader receiver assembly pin that completely passes through the first spreader receiver assembly and the first, spreader;

a second spreader receiver assembly pin that completely passes through the second spreader receiver assembly and the first spreader;

a third spreader receiver assembly pin that completely passes through the third spreader receiver assembly and the second spreader;

a fourth spreader receiver assembly pin that completely passes through the fourth spreader receiver assembly and the second spreader; and a pointed tip along a bottom surface of the first unitary and concave box wall and the second unitary and concave box wall for engaging an Earthen surface;

further comprising a first extended working space area defined between a plane of the coplanar end panels of the first unitary and concave box wall and the three straight panels of the first unitary and concave box wall; and further comprising a second extended working space area defined between a plane of the coplanar end panels of the second unitary and concave box wall and the three straight panels of the second unitary and concave box wall.

2. The apparatus of claim 1, wherein said first and said second unitary and concave box wall and said first and second spreaders form a first bell hole box; and further comprising a second bell hole box stacked on top of said first bell hole box.

3. The apparatus of claim 1, further comprising:

a ladder in a first position that is not connected to the first or second unitary and concave box wall for protecting workers working below the surface of the Earth;

wherein the ladder in a second position is connectable to an interior surface of the first unitary and concave box wall or the second unitary and concave box wall; and wherein a bottom of the ladder in the second position is movable to a swung-out position away from the first unitary and concave box wall or the second unitary and concave box wall.

4. The apparatus of claim 1, further comprising:

a first plurality of guard posts connected to a top surface of the first unitary and concave box wall;

a second plurality of guard posts connected to a top surface of the second unitary and concave box wall;

a first plurality of safety chains connected to the first plurality of guard posts; and a second plurality of safety chains connected to the second plurality of guard posts.

5. An apparatus for protecting workers working on a pipeline down in a bell hole defined below a surface of the Earth, the apparatus comprising:

a first unitary and concave box wall;

a second unitary and concave box wall opposing the first unitary and concave box wall;

wherein the first unitary and concave box wall terminates in two end panels;

wherein the second unitary and concave box wall terminates in two end panels;

wherein the two end panels of the first unitary and concave box wall are parallel to the two end panels of the second unitary and concave box wall;

a first spreader connected between the first unitary and concave box wall and the second unitary and concave box wall; and a second spreader connected between the first unitary and concave box wall and the second unitary and concave box wall;

wherein the end panels of the first unitary and concave box wall are coplanar, and the end panels of the second unitary and concave box wall are coplanar;

wherein the first unitary and concave box wall and the second unitary and concave box wall are mirror images of each other;

wherein the first spreader and the seconder spreader permit passage of the pipeline thereunder;

wherein a longitudinal direction of both the first unitary and concave box wall and the second unitary and concave box wall is generally parallel to a longitudinal direction of the pipeline;

wherein a length of the first spreader and a length of the second spreader are equal, and the length of the first spreader and the second spreader is less than a distance defined between a midpoint of the first unitary and concave box wall and a midpoint of the second unitary and concave box wall;

wherein at least a portion of the first spreader contacts the first unitary and concave box wall and the second unitary and concave box wall;

wherein the first unitary and concave box wall is constructed of three planar panels positioned between and terminating in the two end panels of the first unitary and concave box wall;

wherein the second unitary and concave box wall is constructed of three planar panels positioned between and terminating in the two end panels of the second unitary and concave box wall;

wherein the first spreader and the second spreader are parallel;

wherein each of the three planar panels and the two end panels of the first unitary and concave box wall include a panel body extending between opposing sides;

wherein each of the three planar panels and the two end panels of the second unitary and concave box wall include a panel body extending between opposing sides;

wherein the constructed three planar panels and the two end panels of the first unitary and concave box wall are assembled and fixed together by welding the respective sides together;

wherein the constructed three planar panels and the two end panels of the second unitary and concave box wall are assembled and fixed together by welding the respective sides together; and further comprising a first extended working space area defined between a plane of the coplanar end panels of the first unitary and concave box wall and the three planar panels of the first unitary and concave box wall; and further comprising a second extended working space area defined between a plane of the coplanar end panels of the second unitary and concave box wall and the three planar panels of the second unitary and concave box wall.

6. The apparatus of claim 5, further comprising:

the first unitary and concave box wall having a first spreader receiver assembly defining a first hollow cavity and a second spreader receiver assembly defining a second hollow cavity;

the second unitary and concave box wall having a third spreader receiver assembly defining a third hollow cavity and a fourth spreader receiver assembly defining a fourth hollow cavity;

the first spreader having a portion that resides within the first hollow cavity and the third hollow cavity; and the second spreader having a portion that resides within the second hollow cavity and the fourth hollow cavity, wherein the first unitary and concave box wall, the second unitary and concave box wall, the first spreader, and the second spreader form an eight-sided box.

7. The apparatus of claim 6, further comprising:

a first spreader receiver assembly pin that completely passes through the first spreader receiver assembly and the first spreader;

a second spreader receiver assembly pin that completely passes through the second spreader receiver assembly and the second spreader;

a third spreader receiver assembly pin that completely passes through the third spreader receiver assembly and the first spreader; and a fourth spreader receiver assembly pin that completely passes through the fourth spreader receiver assembly and the second spreader.

8. An apparatus for protecting workers working on a pipeline down in a bell hole defined below a surface of the Earth, the apparatus comprising:

a first unitary and concave box wall;

a second unitary and concave box wall opposing the first unitary and concave box wall;

wherein the first unitary and concave box wall terminates in two end panels;

wherein the second unitary and concave box wall terminates in two end panels;

wherein the two end panels of the first unitary and concave box wall are parallel to the two end panels of the second unitary and concave box wall;

a first spreader connected between the first unitary and concave box wall and the second unitary and concave box wall; and a second spreader connected between the first unitary and concave box wall and the second unitary and concave box wall;

wherein the end panels of the first unitary and concave box wall are coplanar, and the end panels of the second unitary and concave box wall are coplanar;

wherein the first unitary and concave box wall and the second unitary and concave box wall are mirror images of each other;

wherein the first spreader and the seconder spreader permit passage of the pipeline thereunder;

wherein a longitudinal direction of both the first unitary and concave box wall and the second unitary and concave box wall is generally parallel to a longitudinal direction of the pipeline;

wherein a length of the first spreader and a length of the second spreader are equal, and the length of the first spreader and the second spreader is less than a distance defined between a midpoint of the first unitary and concave box wall and a midpoint of the second unitary and concave box wall;

wherein at least a portion of the first spreader contacts the first unitary and concave box wall and the second unitary and concave box wall;

wherein the first unitary and concave box wall is constructed of three first arcuate panels positioned between and terminating in the two end panels of the first unitary and concave box wall, the three first arcuate panels including a central concave panel and a convex panel on each side of the central concave panel;

wherein the second unitary and concave box wall is constructed of three second arcuate panels positioned between and terminating in the two end panels of the second unitary and concave box wall, the three second arcuate panels including a central concave panel and a convex panel on each side of the central concave panel;

wherein the first spreader and the second spreader are parallel;

further comprising a first extended working space area defined between a plane of the coplanar end panels of the first unitary and concave box wall and the three first arcuate panels of the first unitary and concave box wall; and further comprising a second extended working space area defined between a plane of the coplanar end panels of the second unitary and concave box wall and the three second arcuate panels of the second unitary and concave box wall.

* * * * *